US007726512B2

(12) United States Patent
MacCarthy

(10) Patent No.: US 7,726,512 B2
(45) Date of Patent: Jun. 1, 2010

(54) UNIVERSAL FOOD-HOLDING RECEPTACLE FOR USE WITH BEVERAGE CONTAINERS OF DIVERSE SHAPES AND SIZES

(76) Inventor: Patrick MacCarthy, 10802 W. 28 Pl., Lakewood, CO (US) 80215

( * ) Notice: Subject to any disclaimer, the term of this patent is extended or adjusted under 35 U.S.C. 154(b) by 890 days.

(21) Appl. No.: 11/279,363

(22) Filed: Apr. 11, 2006

(65) Prior Publication Data

US 2006/0255050 A1 Nov. 16, 2006

Related U.S. Application Data

(60) Provisional application No. 60/670,118, filed on Apr. 11, 2005.

(51) Int. Cl.
*A47G 19/00* (2006.01)

(52) U.S. Cl. ..... 220/737; 220/23.86

(58) Field of Classification Search ..... 215/395; D7/387, 602, 601; 220/738
See application file for complete search history.

(56) References Cited

U.S. PATENT DOCUMENTS

| | | | | |
|---|---|---|---|---|
| 616,013 | A * | 12/1898 | Robertson | 215/390 |
| 2,372,872 | A * | 4/1945 | Wolper | 141/331 |
| 2,391,528 | A * | 12/1945 | Walker et al. | 248/108 |
| 2,561,022 | A * | 7/1951 | Jones | 220/23.6 |
| 2,920,804 | A * | 1/1960 | Minton | 229/400 |
| D211,532 | S | 6/1968 | Ashton | |
| 3,599,824 | A * | 8/1971 | Pneuman et al. | 220/23.4 |
| 4,732,274 | A | 3/1988 | Bouton | |
| 4,938,373 | A | 7/1990 | McKee | |
| 5,058,737 | A | 10/1991 | Patterson et al. | |
| 5,060,820 | A | 10/1991 | Boerner | |
| 5,176,283 | A | 1/1993 | Patterson et al. | |
| 5,180,079 | A | 1/1993 | Jeng | |
| 5,207,743 | A | 5/1993 | Costarella et al. | |
| 5,234,125 | A | 8/1993 | Roberts | |

(Continued)

FOREIGN PATENT DOCUMENTS

| | | |
|---|---|---|
| DE | 29609115 | 8/1996 |

(Continued)

OTHER PUBLICATIONS

Official Action for U.S. Appl. No. 11/279,366, mailed Feb. 11, 2009.

*Primary Examiner*—Anthony Stashick
*Assistant Examiner*—Robert J Hicks
(74) *Attorney, Agent, or Firm*—Sheridan Ross PC

(57) ABSTRACT

An aid for dining in stand-up and similar situations where a person may simultaneously support a plate and a beverage container by a single hand. The invention comprises a universal food holding receptacle that is stably mountable on upright beverage containers of widely diverse shapes and sizes. The user holds a lower portion of the beverage container in one hand and uses the other hand for other activities such as taking food items from the food holding receptacle that is supported on the beverage container. The food holding receptacle is stably mounted on the beverage container in loose-fitting relationship so that the receptacle can be repeatedly mounted on and demounted from the beverage container in a facile manner while dining. The same food holding receptacle may also be used, after turning upside-down, to stably support beverage containers of diverse shapes and sizes.

61 Claims, 18 Drawing Sheets

U.S. PATENT DOCUMENTS 5,240,136 A 8/1993 Patterson et al.
5,249,700 A 10/1993 Dumke
5,259,528 A 11/1993 Pace et al.
5,292,028 A 3/1994 Patterson et al.
5,339,979 A * 8/1994 Box ..... 220/529
5,346,070 A 9/1994 McSpadden
5,361,932 A 11/1994 Friedrich
5,396,996 A * 3/1995 Box ..... 211/46
5,419,455 A * 5/1995 Russeau ..... 220/575
5,421,459 A 6/1995 Mazzotti
5,662,240 A 9/1997 Norris
5,695,052 A 12/1997 Damato
5,732,847 A 3/1998 Caldi
5,915,561 A * 6/1999 Lorenzana et al. ..... 206/562
5,954,195 A 9/1999 Krueger et al.
5,984,131 A 11/1999 Krueger et al.
6,021,914 A * 2/2000 Schmidt ..... 220/574
6,138,860 A 10/2000 Comeaux
6,338,417 B1 1/2002 Ferraro
6,360,885 B1 3/2002 Krueger et al.
6,425,480 B1 7/2002 Krueger et al.
6,427,864 B1 8/2002 Asselin
6,474,494 B1 11/2002 Miller
6,609,625 B1 8/2003 Gibbar
6,706,297 B1 3/2004 Toth et al.
6,824,002 B1 11/2004 Hadland
D509,994 S 9/2005 Hadland
2004/0099670 A1 5/2004 Michaeli
2006/0261075 A1 11/2006 MacCarthy

FOREIGN PATENT DOCUMENTS

DE 296090115 8/1996

* cited by examiner

UNIVERSAL FOOD-HOLDING RECEPTACLE FOR USE WITH BEVERAGE CONTAINERS OF DIVERSE SHAPES AND SIZES

CROSS-REFERENCE TO RELATED APPLICATIONS

This application claims priority to Provisional Patent Application Ser. No. 60/670,118, entitled UNIVERSAL FOOD RECEPTACLE FOR USE WITH BEVERAGE CONTAINERS OF DIVERSE SHAPES AND SIZES, filed Apr. 11, 2005 and is incorporated herein by reference in its entirety.

FIELD OF INVENTION

This invention relates to a novel type of food holding receptacle such as a plate, bowl, dish, tray or similar food holding item. More particularly it relates to a plate, bowl, dish, tray or the like that is of special value to a diner who wishes to support both the food holding receptacle and beverage container by a single hand. This leaves the user's second hand free for removing food items from the food holding receptacle or for other purposes. Still more specifically the present invention provides a food holding receptacle that is stably mountable on a beverage container that is held in a user's hand. The food holding receptacle of the present invention is universal and designed so that a particular receptacle is suitable for use with beverage containers of widely diverse shapes and sizes. The present invention is of value in many common situations such as parties, barbeques, picnics, and sporting events. The invention also has value in fast food restaurants, cafeterias, hospitals, and so on.

BACKGROUND OF THE INVENTION

Guests at cocktail parties often stand while eating. In such cases, they frequently hold a plate of food in one hand and a beverage container in the other hand. This creates a problem in trying to transfer food from the plate to one's mouth using the hand that is holding the beverage container. There is also difficulty in trying to support both the plate and beverage container by a single hand while using the other hand to transfer the food to one's mouth. Similar situations occur at other types of parties, and at picnics, barbeques, and sporting events, in fast food restaurants, cafeterias, airports, and other venues where food and beverage are served. The difficulty of trying to support a food holding receptacle and a beverage container simultaneously either while eating or while carrying the food and beverage represents a long-standing problem and the problem continues to the present day.

This problem of trying to comfortably hold a plate of food and a beverage container in a stand-up dining situation has been the subject of many patented inventions. Each of these prior art inventions suffers from one deficiency or another that, apparently, has prevented the widespread adoption of any one of those inventions.

There are two general approaches in the prior art to simultaneously supporting a food holding receptacle and a beverage container by a single hand. In the first general approach the beverage container is held in one hand and a plate or other food holding receptacle is supported on or by the beverage container. For example, U.S. Pat. No. 4,938,373 issued to McKee describes a plate that is supportable on a beverage container. The plate is similar to a regular plate, but the base of the plate has an upwardly protruding annular, hollow ridge. The cross section of the ridge resembles an inverted "V".

Accordingly, the ridge has a hollow, upward facing, annular cavity on its undersurface. The upper part (rim) of a beverage container such as a glass or a paper cup is press fit into the cavity of the inverted "V" allowing the plate to be supported on the beverage container. The plate described in U.S. Pat. No. 4,938,373 is not stably supportable on beverage containers of a wide variety of shapes and sizes; it is stably mountable only on those beverage containers with upper diameter (rim) dimensions that match the annular cavity dimensions.

In another variation of this general approach (U.S. Pat. No. 5,695,052 issued to Damato) the base of the plate contains a radially scored section. The beverage container is forced downward through the scored region of the plate creating a cavity in the plate that encircles the beverage container. The plate is held on the beverage container by the force-fit between the two components. In this approach the beverage container, with the supported plate, is held in one of the user's hands, leaving the user's other hand free to remove items of food from the plate. There are several problems with this approach including the difficulty of removing the plate from, and replacing the plate on, the beverage container without spilling some of the beverage or tossing food items from the plate. This is especially true considering that the plate must generally be repetitively mounted on and demounted from the beverage container in a dining situation.

In another variation of this approach (U.S. Pat. No. 6,138,860 issued to Comeaux), a plate sits directly on top of a drinking glass. The underside of the plate has a non-slip surface to hinder the plate from sliding off the glass. In this case the user holds the beverage container in one hand, while the plate is supported by the beverage container. This invention suffers from several disadvantages. For example, if another person bumped into the diner, the plate could be easily knocked off the beverage container. Such a design would be even less satisfactory for use with certain beverage containers such as bottles.

In still another variation of this approach, exemplified by U.S. Pat. Nos. 5,954,195; 5,984,131 and 6,360,885 all issued to Krueger and Perez; and U.S. Pat. No. 6,425,480 issued to Krueger, Perez and Jansson the base of the food holding receptacle contains an upwardly protruding hollow hub that is attached to the base of the plate. The food holding receptacle is pressed onto the upper portion of the beverage container; the beverage container enters the hub from below the plate, through a hole in the base of the plate, until the hub snugly surrounds part of the upper portion of the beverage container. The user holds the beverage container in one hand with the plate supported by the beverage container. This leaves the user's other hand free to pick food items from the plate or for greeting other people. The inventions using this approach as described in the above-cited prior art patents suffer from the disadvantage that different hub shapes are required for beverage containers of different shapes and sizes. For example, U.S. Pat. No. 5,954,195 describes several embodiments of such a plate, each with a differently shaped hub to snugly fit part of the outer surface of different beverage containers. The plate is mounted on a beverage container by pressing the plate onto a top portion of the beverage container. One of these embodiments has a hub with an interior section that matches exactly the outer surface of a conventional beverage can; that embodiment is designed to be supported on a conventional beverage can.

Another embodiment shown in U.S. Pat. No. 5,954,195 is designed to be supported on frusto-conical shaped beverage containers such as those in the shape of the commonly used paper or plastic disposable cups. Another embodiment shown in U.S. Pat. No. 5,954,195 is designed to be supported on a particular shaped bottle. The snug-fitting, or tight fitting, relationship between the food holding receptacles and the beverage containers in U.S. Pat. No. 5,954,195 hinders the facile mounting of the food-containing receptacle on a beverage container and also hinders the removal of the receptacle from a beverage container. Repetitive and facile mounting and demounting of a receptacle is important for a food holding receptacle that is mountable on a beverage container and intended for use in a dining situation such as a cocktail party.

U.S. Pat. No. 5,984,131 describes a food holding receptacle in the form of a plate-lid that is designed for mounting on a beverage container with an upper portion of specific dimensions. U.S. Pat. No. 6,360,885 describes a food holding receptacle that is mountable on frusto-conical cups of different sizes. U.S. Pat. No. 6,425,480 discloses plates each requiring a differently shaped hub for use with bottles of different shapes. In each of the Krueger et al. patents described above the inner surface of the hub is designed to be complementary in shape to part of the outer surface of a specific beverage container in a manner that the hub snugly surrounds part of the beverage container. Such receptacles, if commercialized, would require the availability of several receptacles with hubs of different interior shapes and dimensions to accommodate different beverage containers such as bottles, cans, stemware glasses, and so on. The need for multiple food holding receptacles with hubs of different dimensions to accommodate beverage containers of different shapes and sizes represents a significant obstacle to the widespread commercialization of these receptacles and would generate consumer hesitance in purchasing them.

U.S. Pat. No. 5,060,820 issued to Boerner has a downwardly extending member or members on the underside of the base of a plate. This member extends essentially perpendicular to the base of the plate and lies alongside the outer wall of a beverage container upon which the plate is supported. The user simultaneously grasps the extending member and the beverage container by a single hand and thereby supports both the plate and the beverage container. In an alternative embodiment of the Boerner invention the downwardly extending member is in the form of a cylindrical arc that extends around more than half the circumference of a cup with a handle, thereby directly supporting the plate; in this case the user does not grasp the extending member but holds the cup by its handle, with the plate supported on the cup. Mounting Boerner's plate on a beverage container requires coordinating the position of the downwardly extending member or members with the position of the users hand relative to the beverage container or the position of a cup handle.

U.S. Pat. No. 5,662,240 issued to Norris comprises a plate having handles in the form of loop-shaped members extending downwardly from the underside of the plate. The plate is placed on top of a beverage container that is held in a user's hand, and the plate is gripped by the user placing a finger and a thumb from the hand that is holding the beverage container through the loops. Mounting of such a plate on a beverage container requires proper orientation of the plate relative to the fingers of a user who is holding the beverage container; this attention to the relative orientation of the plate combined with the need to insert fingers into loop shaped members renders the repetitive mounting and demounting of such a plate cumbersome.

Other approaches to mounting a plate or similar receptacle on a beverage container are disclosed in U.S. Pat. Nos. 5,058,737; 5,176,283; 5,240,136; and 5,292,028 all issued to Patterson and Patterson; U.S. Pat. No. 5,180,079 issued to Jeng; U.S. Pat. No. 5,732,847 issued to Caldi; and U.S. Pat. No. 6,427,864 issued to Asselin.

The second general approach to simultaneously supporting a food holding receptacle and a beverage container by a single hand involves holding the receptacle in one hand with the beverage container supported on or by the receptacle. For example, U.S. Pat. No. 5,207,743 issued to Costarella and Shohara describes a plate containing a downwardly extending hollow tubular section. The beverage container is mounted on the plate by inserting the beverage container into the hollow section. The beverage container rests on the side walls of the hollow section. The user holds the outer wall of the tubular section in one hand with the beverage container supported on the plate. This plate is not designed for supporting beverage containers of a wide variety of shapes and sizes. While the plate is capable of holding beverage containers with lower portions that are roughly frusto-conical in shape, some parallel-sided vessels such as many cups, bottles, cans and glasses will simply slip through the hollow tubular section.

In another variation of this approach (U.S. Pat. No. 5,249,700 issued to Dumke) the base of the plate contains a hole in the center surrounded by an upwardly-protruding frusto-conical lip. The beverage container is inserted in the hole from above the plate and rests on the perimeter of the hole. The plate, with the beverage container supported thereon, is held in one of the user's hands, leaving the user's other hand free to remove items of food from the plate. There are several problems with this approach including its unsuitability for use with some beverage containers that are not frusto-conical in shape.

In still another variation of this approach exemplified by U.S. Pat. No. 5,346,070 issued to McSpadden the base of a tray has a section containing a substantially cup-like depression. The beverage container is mounted on the plate by placing the bottom portion of the container into the cup-like depression from above. The beverage container rests inside the cup-like depression. The bottom of the cup-like depression may be removable to facilitate taller (frusto-conical) cups, in which case the container protrudes from the underside of the depression. The user holds the outer wall of the cup-like depression in one hand while the plate is resting on part of that hand and wrist. This leaves the user's other hand free to pick food items from the tray or for other activities. This approach suffers from the disadvantage that many types of beverage containers cannot be stably and comfortably supported on or by the tray.

Other approaches to supporting a beverage container on or by a plate or similar receptacle are disclosed in U.S. Pat. No. 5,234,125 issued to Roberts; U.S. Pat. No. 5,259,528 issued to Pace and Girovich; U.S. Pat. No. 5,361,932 issued to Friedrich; U.S. Pat. No. 5,421,459 issued to Mazzotti; and U.S. Pat. No. D211,532 issued to Ashton. The plate disclosed by McKee in U.S. Pat. No. 4,938,373 (described above) is also capable of supporting a beverage container.

In addition to the prior art found in patents, there have been and are several items on the market for addressing the problem of supporting a plate and a beverage container simultaneously while dining. In particular, plates variously referred to as party plates, cocktail plates or buffet plates are available for holding stemware. Some of these commercial products are occasionally seen at buffet functions and can be found in specialty stores. However, none of these commercial products has gained widespread acceptance. Most stand-up dining events do not use such plates, and these plates are generally not found in supermarkets and department stores.

A major deficiency in all of the inventions embodied in the above-cited patents and commercial products is that none of them is universally applicable to a wide variety of beverage containers of different shapes and sizes. In particular, no single prior art plate for addressing the problem at hand is suitable for effective use with bottles, cans, stemware glasses, non-stemware glasses, cups and mugs. The prior art teaches the use of differently configured plates for different types of beverage container. Accordingly, stores would have to provide multiple versions of such plates if they were to accommodate the diverse shapes and sizes of common beverage containers. Similarly, consumers would have to purchase several versions of such plates, each specifically designed for different types of beverage containers. Fast food establishments and cafeterias would similarly have to provide a different food holding receptacle depending on the beverage container chosen by a customer. However, some recent disclosures have addressed the issue of food holding receptacles intended for use with several types of beverage containers. In U.S. Pat. No. 6,609,625, Gibbar describes a drink vessel holder that is supported on a plate; the drink vessel that is held within the drink vessel holder is supported on and by the plate, and the plate is held in the user's hand. Gibbar states (Col. 2, lines 26-28) that "Such a device must be able to accommodate a large variety of drink vessels that are commonly found at parties." A disadvantage of Gibbar's device is that it requires the hand that is holding the plate to also secure the drink vessel holder to the surface of the plate; alternatively the user must use an adhesive strip to attach the drink vessel holder to the plate. US Pat. Application 20040099670 to Michaeli describes a plate having a peripheral recess with a wall that partly surrounds and supports a beverage container. The wall is made of a flexible material that "is sufficiently flexible to receive and accommodate beverage containers of different diameters" (Abstract). Michaeli states that "beverage containers of most shapes and sizes" (Col. 2, Par. 0025) and "cans, bottles or cups" of a specified diameter (Col. 2, Par. 0026) can be accommodated by the plate of his invention. This design has several deficiencies. Part of the plate must be made from a flexible material. Also, the user grasps both the beverage container and the plate thereby requiring an extra degree of dexterity and care by the user.

The present invention provides a food holding receptacle that is capable of being stably supported on a wide variety of bottles, cans, stemware glasses, non-stemware glasses, cups and mugs, taken one beverage container at a time. A given sample of the present invention is not limited to specific dimensions for the beverage container. In addition to those capabilities some embodiments of the present invention are also capable of stably supporting a variety of bottles, cans, glasses, cups and mugs, taken one beverage container at a time.

The problem of trying to support both a food holding receptacle and a beverage container simultaneously is not limited to the immediate period during which the food and beverage are being consumed. For example, it can be awkward trying to make one's way through a throng of people in a stadium or other packed event while carrying a food holding receptacle and a beverage container simultaneously. The present invention alleviates that problem.

DEFINITIONS OF TERMS

The following terms are defined as used in the specification and claims of this patent. Other terms are defined or explained at their point of usage in the specification.

Food holding receptacle: This is a container for holding food in a dining situation such as a plate, a bowl, a dish, or a tray; the food holding receptacle can also be used when carrying food and or beverage.

Plate: A plate for holding food, one of various food holding receptacles.

All food holding receptacles of the present invention have a first specified food holding orientation; this refers to the orientation of the receptacle when it is being used in dining. Some embodiments of the food holding receptacle have two specified food holding orientations, a first specified food holding orientation and a second specified food holding orientation.

The plate of the present invention contains a base, that is, a bottom section that is usually, though not necessarily, flat. A flat base would be essentially horizontal when the receptacle is in one of its specified food holding orientations.

The base has a first surface that can function as a first food holding section and has a second surface on the face opposite the first surface that in some embodiments may function as a second food holding section.

There are three possible modes for using the food holding receptacle of the present invention. In mode 1 the food holding receptacle in its first specified food holding orientation is stably mounted on a beverage container directly and the user grasps the beverage container by a single hand. Some embodiments may also be used in mode 2. In mode 2 of using the receptacle of the present invention a beverage container is stably supported on the food holding receptacle in its second specified food holding orientation and the food holding receptacle is held by a single hand. In mode 3, the food holding receptacle is stably mounted on a beverage container through a connector unit. A lower portion of the connector unit snaps, or otherwise firmly connects, onto the upper portion of the beverage container. The upper portion of the connector unit is insertable into the underside of the receptacle in its first specified food holding orientation and the receptacle is thereby mountable on the connector unit. The user grasps the beverage container by a single hand as in mode 1 and thereby supports the food holding receptacle. The beverage container acts as a handle for gripping and for supporting the food holding receptacle in mode 1 and mode 3.

In modes 1 and 3 of using the food holding receptacle, the receptacle is positioned in its first specified food holding orientation. If the plate of the present invention were to be placed in its first specified food holding orientation on a table, the first surface would face upward, and would be suitable for holding food items. The second surface would face downward and would be in contact with the surface of the table.

The plate (or other food holding receptacle) contains a rim, that is, an upwardly positioned segment or wall near the outer edge of the plate when the plate is oriented in one of its specified food holding orientations; the rim prevents food from falling over the edge of the base. Throughout this disclosure it is assumed that the plate (or other food holding receptacle) is positioned with its base generally horizontal when in use, as with a conventional plate. The base could be curved with a wok-type shape where the first food holding surface is concave; in this case, there may be no need for the plate to have a distinct rim.

The food holding receptacle of the present invention has a hole or opening that penetrates the base of the receptacle—the hole extends completely through the base. The hole may have any of several shapes including circular, polygonal and other shapes.

Embodiments of the food holding receptacle of the present invention have a collar that protrudes upwardly from the hole or from the vicinity of the hole when the receptacle is in its first specified food holding orientation. This collar is hollow and has an inner surface with a non-uniform cross section; the cross section has a greater internal diameter in the vicinity of the hole than in a region further upward from the hole. In other words, the collar has a constriction upward from the hole in the base when the receptacle is in its first specified food holding orientation. The internal surface of the collar is non-cylindrical and is specially contoured so that it accommodates drinking vessels of many diverse shapes and sizes (mode 1). The constriction allows beverage containers to be partially, but not completely, inserted into the collar from the underside of the receptacle (in its first specified food holding orientation). As a result, the food holding receptacle of the present invention can rest on, and be stably supported by, the beverage container. The collar also has an outer surface. In mode 3, the connector unit is partially insertable into the collar from the underside of the receptacle and the receptacle is mountable on the connector unit.

The collar serves as a mounting device that renders the receptacle stably mountable on beverage containers.

In mode 2 of using the food holding receptacle of the present invention, the plate (or other food holding receptacle) is positioned in its second specified food holding orientation. The second specified food holding orientation is produced by rotating the plate essentially 180° relative to the first specified food holding orientation about a horizontal axis. In the second specified food holding orientation the collar extends below, or largely below, the level of the base. In mode 2 a diner holds the food holding receptacle in one hand while a beverage container rests on the food holding receptacle. The lower part of a beverage container (in its specified beverage holding orientation) can be inserted into the chamber of the collar from above and the constriction in the collar prevents the beverage container from falling through the collar. The user grasps the collar by a single hand thereby supporting the receptacle with the beverage container sitting in the chamber of the collar.

The term beverage container refers to any drinking vessel such as a bottle, a can, a stemware glass, a non-stemware glass, a cup, a mug, and so on. While the term beverage container is used throughout this disclosure it is clear that certain beverage containers, such as some glasses and frusto-conical cups, could also be used to hold other food items such as a milkshake or ice cream, or solid items such as French fries, a salad, a dessert, popcorn and so on. Accordingly it is understood that the beverage container in the present disclosure could be used to hold other food items, particularly in mode 2 of using the food holding receptacle.

The term specified beverage holding orientation applies to the beverage container in its upright position, referring to the normal orientation of an open beverage container when it is used for holding a beverage while dining (even though the food holding receptacle of the present invention may be used in conjunction with unopened or closed beverage containers). The term glass or glasses refers to certain beverage containers regardless of the material of which they are made such as glass, plastic, metal, wood, and so on.

The term can or cans refers to beverage containers such as the cans in which soda and beer are commonly sold to the consumer.

The term stemware applies to beverage containers that have a bulb-shaped receptacle for holding a beverage where the bulb is attached to a stem which in turn is connected to a pedestal. Wine glasses generally fall into the stemware category.

Non-stemware glasses do not have a stem or pedestal and include regular drinking glasses such as those commonly used for serving water, milk, soft drinks, etc.

The term upper portion used in relation to a beverage container refers to any portion of a beverage container generally above a section used to grip the beverage container by one's hand. Thus, while the term upper portion of a beverage container could include the top of the beverage container the term is not limited to the top; for example, the receptacle of the present invention may rest on an upper portion of a long-neck bottle referring to the shoulder of the bottle; in this case the top of the bottle may protrude above the level of the collar. A portion of the bottle extending below the receptacle is gripped by the user (mode 1). In the case of a mug having a handle the upper portion lies above the level of the handle.

In the specification and claims of this disclosure the terms stable and stably refer to the mounting or supporting of the food holding receptacle on a beverage container, when the receptacle is in its first specified food holding orientation (modes 1 and 3); these terms also refer to supporting a beverage container by a food holding receptacle when the food holding receptacle is in its second specified food holding orientation (mode 2). The terms stable and stably, in the context of mode 1, mean that the food holding receptacle, in its first specified food holding orientation, is mounted on the beverage container in such a manner that the receptacle does not easily fall off or slide off the beverage container and that the receptacle is not easily knocked off the beverage container even when the user is given a jolt. The previous comment also applies to mode 3, where a connector unit is used to attach the food holding receptacle to the beverage container. Typically, the food holding receptacle in several embodiments of the present invention would not fall off the beverage container even when the beverage container is tilted as much as 70° to 80° from its specified beverage holding orientation (modes 1 and 3), regardless of whether the beverage container is a bottle, a can, a stemware glass, a non-stemware glass, a cup or a mug. The stable mounting of the food holding receptacle of the present invention on beverage containers of diverse shapes and sizes can be further illustrated as follows. A beverage container is held in its specified beverage holding orientation and the receptacle is stably mounted on the beverage container. When the beverage container is then oscillated in a horizontal line at a frequency up to 180 Hz and at an amplitude of about 9 inches for a period of about one minute, the receptacle remains stably mounted on the beverage container. Despite this stable mounting of the food holding receptacle on the beverage container the receptacle is readily removed from the beverage container (mode 1) or from the connector unit that is mounted on the beverage container (mode 3) simply by lifting the receptacle upwards while maintaining the beverage container stationary, or by moving the beverage container downward while holding the receptacle stationary, or by moving the receptacle upward while moving the beverage container downward. In mounting the receptacle on the beverage container, and in separating the mounted receptacle from the beverage container no special forces have to be overcome other than that due to gravity. The receptacle does not have to be pressed or forced onto the beverage container in order for the receptacle to be stably mounted on the beverage container. These features result from the loose-fitting relationship between the food holding receptacle of the present invention and the beverage container upon which it is mounted, as discussed below.

The terms stable and stably in the context of the second specified food holding orientation (mode 2) of the food holding receptacle mean that the beverage container is supportable on the food holding receptacle in such a manner that the beverage container is not easily knocked off the food holding receptacle even when the user is given a jolt. Typically, the beverage container in several embodiments of the present invention would not fall off the food holding receptacle even when the receptacle is tilted as much as 70° to 85° from its second specified food holding orientation. The food holding receptacle in its second specified food holding orientation (mode 2) is particularly well suited for stably supporting frusto-conical cups, common beverage cans, and other beverage containers. Despite this stable supporting of the beverage container on the food holding receptacle, the beverage container is readily removed from the receptacle simply by lifting the beverage container upwards while maintaining the food holding receptacle stationary, or by moving the receptacle downward while holding the beverage container stationary, or by moving the beverage container upward while moving the receptacle downward.

When the receptacle of the present invention is stably and loosely mounted on a beverage container the receptacle is generally suspended from an upper portion of the beverage container. The section of the inner surface of the collar, or of the perimeter, that rests on the beverage container is referred to as the suspension region of the receptacle. Beverage containers having upper portions of different dimensions support the receptacle at different contact regions on the inner surface of the collar; accordingly, a given receptacle can have different suspension regions for different beverage containers.

The term freely supported, freely mounted, or freely mountable is used in association with supporting or mounting of the receptacle on a beverage container. A freely supported or freely mounted food holding receptacle means that the receptacle is supported or mounted on a beverage container:

(i) in the absence of any form of active engagement between the receptacle and container (such as a press-fit, snap-on, screw-on, twist-on, tongue-in-groove or other such type of specific connection), and, (ii) without the user having to grip any part of the receptacle or any appendage depending from the receptacle in order to maintain the receptacle firmly mounted on the beverage container.

Inversion of a beverage container having a food holding receptacle mounted thereon according to its prescribed method of use causes the receptacle to fall off the beverage container if the receptacle is freely supported on the beverage container.

The term universal refers to the food holding receptacle and to the combination of the food holding receptacle with beverage containers taken one beverage container at a time. The food holding receptacle of the present invention is stably mountable on many beverage containers of diverse shapes and sizes, taken one beverage container at a time. Some embodiments of the food holding receptacle can also stably support beverage containers of diverse shapes and sizes. The universality of the present invention results from the design of the collar portion of the food holding receptacle. The collar in the present invention was developed so that a single collar would accommodate beverages containers of widely different shapes and sizes. The invention was also developed to address the general lack of a food holding receptacle—regardless of how it works—that is usefully mountable on a wide variety of beverage containers of different shapes and sizes as found in the marketplace, taken one beverage container at a time. The collar of the food holding receptacle in some embodiments of the present invention was designed to be compatible with the upper portion of many beverage containers when the receptacle is in its first specified food holding orientation (mode 1), and to be also compatible with the lower portion of many beverage containers when the receptacle is in its second specified food holding orientation (mode 2) [while each beverage container is maintained in its specified beverage holding orientation].

The term taken one beverage container at a time in the specification and claims is used to emphasize that: (1) while a given food holding receptacle of the present invention is stably mountable on beverage containers of many shapes and sizes in the first specified food holding orientation it is only mountable on a single beverage container at a time; and (2) while beverage containers of several different shapes and sizes are stably supportable on a given food holding receptacle of the present invention in its second specified food holding orientation, only a single beverage container can be supported by the receptacle at a time. The food holding receptacle of the present invention and, in particular the collar portion of the receptacle, are considered to be universal because they are designed to be compatible with beverage containers of a wide variety of shapes and sizes, such as bottles, cans, stemware glasses, non-stemware glasses, cups and mugs.

The inner surface of the collar of the present invention is non-cylindrical. In fact, the inner surface is specifically contoured to be supportable on beverage containers encompassing a wide variety of shapes and sizes taken one beverage container at a time. Alternatively, the collar may be cylindrical with a protrusion or protrusions extending from its inner surface that renders the inside region of the collar effectively non-cylindrical and supportable on many beverage containers of a wide variety of shapes and sizes. The term non-cylindrical refers to both of the above situations when used to describe the inner surface of the collar. The collar of the present invention has been designed such that the collar, and the food holding receptacle as a whole, is compatible with and: (1) stably supportable on beverage containers that are non-cylindrical as well as containers that are cylindrical or predominantly cylindrical; and (2) able to stably support beverage containers that are non-cylindrical and containers that are cylindrical or predominantly cylindrical. The special contouring of the inner surface in the collar of the food holding receptacle is responsible for this universal feature.

The inner surface of the collar is generally noncongruent with the portion of the outer surface of the beverage container surrounded by the collar when the receptacle is stably mounted on the beverage container or when a beverage container is supported by the collar of the receptacle. That means that generally the inner surface of the collar does not engage the outer surface of the beverage container in a snug fitting or tight fitting relationship. This general non-congruence is a necessary requirement for a universal food holding receptacle of the type described in this invention. The collar can only be congruent with a section of a beverage container of a single shape and size, but in the present invention the receptacle must be stably mountable on beverage containers of many diverse shapes and sizes and/or must stably support beverage containers of diverse shapes and sizes. For these reasons the association of the food holding receptacle of the present invention with each beverage container is through a loose-fitting relationship, as discussed in the next paragraph.

The terms loose-fitting and loosely are used interchangeably and refer to the relationship between a beverage container and a food holding receptacle supported on the beverage container. Because of the loose-fitting relationship between the food holding receptacle of the present invention and a beverage container upon which the receptacle is mounted:

(i) the food holding receptacle can be stably mounted on the beverage container by gently lowering the receptacle onto the beverage container. The receptacle does not have to be pressed onto the beverage container;

(ii) the mounted receptacle can be readily separated from the beverage container by gently lifting the receptacle upwards relative to the beverage container or by gently lowering the beverage container relative to the receptacle, without having to exert any particular force other than that due to gravity; and, (iii) the receptacle, in its first specified food holding orientation, can generally be readily rotated relative to the beverage container about a vertical axis while the receptacle is stably mounted on the beverage container.

For some embodiments of the invention, the beverage container is inserted into the chamber of a collar of the food holding receptacle without experiencing any significant resistance due to friction or other forces until the beverage container encounters a restricting means which allows the collar to rest on part of the beverage container.

The term beverage containers of diverse shapes, diverse sizes, or diverse shapes and sizes, in whole or in part, is used extensively throughout this disclosure. The term shape refers to the geometry or configuration of a beverage container. For example, a typical soda can, a beer bottle, and a wine glass are three beverage containers of quite different shapes. One can find many different shapes even within a given class of beverage container such as bottles. The term size refers to the actual dimensions of beverage containers, particularly in the upper portion of beverage containers. A typical beer can (12 oz.) and the can used for holding Red Bull® (8.3 oz.) beverages are both of the same general shape but they are of different sizes.

SUMMARY OF THE INVENTION

There is need for an effective means of simultaneously supporting both a food holding receptacle and a beverage container by a single hand while dining, leaving the user's second hand free to remove food items from the food holding receptacle or for other purposes. In order to enhance the commercial viability of such a device a single food holding receptacle must be sufficiently versatile to be comfortably and effectively used with any of a variety of beverage containers of diverse shapes and sizes as found in the marketplace. More specifically, such a food holding receptacle should preferably be suitable for use with several or all of the following: a bottle chosen from a wide variety of bottles of different sizes and shapes; a beverage can chosen from a variety of beverage cans of different sizes and shapes; a stemware glass chosen from a wide variety of stemware glasses of different sizes and shapes; a non-stemware glass chosen from a wide variety of non-stemware glasses of different sizes and shapes; a cup chosen from a wide variety of cups of different sizes and shapes; and a mug chosen from a variety of mugs of different sizes and shapes.

The present invention provides an aid for dining in stand-up situations (and other situations where the diner does not have the benefit of a table such as in a movie theatre, traveling on a bus or while walking) and is an improvement on devices described in the above-cited patents. More specifically the present invention provides a universal food holding receptacle. The universal food holding receptacle of the present invention can be stably mounted on a beverage container chosen from beverage containers representing a wide variety of shapes and sizes (mode 1) or alternatively a beverage container chosen from beverage containers representing a wide variety of shapes and sizes may be stably supported by the receptacle (mode 2).

In mode 1, and choosing a plate as an example of a food holding receptacle of the present invention, the plate is stably mountable on beverage containers of diverse shapes and sizes, taken one beverage container at a time. The beverage container is held in one of the user's hands. The plate is stably mounted on the beverage container, leaving the user's other hand free to pick items of food from the food holding receptacle or for greeting other people. The universal food holding receptacle of the present invention is configured such that it is stably mountable on beverage containers of diverse shapes and sizes. Accordingly, a single version (shape and size) of such food holding receptacle is stably mountable on a wide variety of bottles, cans, non-stemware glasses, stemware glasses, cups and mugs taken one beverage container at a time. In other words, the food holding receptacle of the present invention is essentially universal in terms of its ability to be used with beverage containers of widely diverse shapes and sizes. This universality makes the food holding receptacle of the present invention more commercially attractive to the consumer. Mode 2 of using the food holding receptacle of the present invention, as described later in this disclosure, further enhances the versatility and universality of the present invention.

In a preferred embodiment of the present invention, the food holding receptacle has a hole in its base. Protruding from this hole is a collar that extends upwardly when the receptacle is in its first specified food holding orientation. The collar is composed of a hollow tubular segment and looks like a chimney protruding upwardly from the base of the receptacle. The collar encloses a chamber into which beverage containers can be partially inserted, one beverage container at a time. The food holding receptacle in its first specified food holding orientation can be mounted on a beverage container in its specified beverage holding orientation whereby the collar surrounds part of the beverage container. The collar of the receptacle is constructed so that the beverage container can penetrate the collar only partially before encountering a constriction (or other restriction) that prevents further entry of the beverage container. This constriction or obstruction allows the receptacle to be supported on the beverage container. A sufficient portion of the beverage container protrudes from underside the food holding receptacle, when the receptacle is mounted thereon, to allow a person to firmly grip the beverage container. A person grips the beverage container at a point underneath the receptacle and thereby supports the beverage container and plate by means of a single hand. This leaves the other hand free to manipulate food on the receptacle. In experimenting with prototypes it was found that the food holding receptacle of the present invention was surprisingly versatile being stably mountable on numerous beverage containers of widely diverse shapes and sizes, taken one beverage container at a time.

The food holding receptacle of the present invention can be used as follows when the receptacle is in its first specified food holding orientation (mode 1). A person places food on the first (upward facing) surface of the receptacle which serves as the first food holding section. The receptacle is then mounted on the beverage container in its specified beverage holding orientation as described above. Alternatively, a person may first mount the food holding receptacle on the beverage container and then place the food items on the receptacle. One is not limited to a beverage container of a specific class or size, because beverage containers of widely diverse shapes and sizes are accommodated by the universal food holding receptacle of the present invention. The shape and internal dimensions of the collar do not have to match the external shape and dimensions of the section of the beverage container upon which the receptacle is supported. In fact the inner surface of the collar may have a shape and size quite different from the upper section of the beverage container. In other words, the inner surface of the collar does not have to be congruent with the section of the outer surface of the beverage container that is surrounded by the collar. When the food holding receptacle is stably mounted on a beverage container the inner surface of the collar surrounds part of the beverage container in a loose fitting relationship. The user can now hold the beverage container with the food holding receptacle supported thereon, by a single hand in a convenient and stable manner. The user can conveniently and comfortably pass food from the receptacle to his or her mouth using the hand that is not gripping the beverage container. When a person wishes to drink some of the beverage, it is a simple matter to grip the food holding receptacle in the conventional manner, by the free hand, remove the beverage container from beneath the receptacle, and drink from the beverage container in the conventional manner. In some cases, the user may wish to use a straw in order to drink from the beverage container while the food holding receptacle is mounted thereon, where the straw is inserted through the top of the collar and into the beverage container. In this case there is no need to remove the food holding receptacle from the beverage container while one is dining.

Going through a food line with the food holding receptacle of the present invention mounted on a beverage container is more convenient than when holding a conventional plate at its rim; in the case of the present invention, the beverage container serves as a centrally located handle for stably supporting the food holding receptacle in a symmetrical and balanced manner.

When the food holding receptacle of the present invention is a plate, some embodiments of the receptacle can also be used in a second specified food holding orientation wherein the collar extends downward (rather than upward as in the first specified food holding orientation) from the first surface of the base which is now facing downward. This method of using the receptacles is referred to as mode 2. The second specified food holding orientation is obtained by rotating the receptacle essentially 180° with respect to the first specified food holding orientation, about a horizontal axis. In this case, the bottom part of the beverage container in its specified beverage holding orientation is inserted into the chamber of the collar from above the receptacle. The constriction in the collar prevents the beverage container from passing completely through the collar. The beverage container is supported by the collar of the food holding receptacle and the user holds the receptacle by grasping the outer surface of the collar. In this case, food items are placed on the second surface of the receptacle that functions as the second food holding section of the receptacle. Mode 2 works particularly well with frusto-conical cups of many different sizes such as the paper and plastic disposable cups commonly used for holding coffee, water, soda and beer, and also with cans and other beverage containers.

In an alternative way of using the food holding receptacle of the present invention a connector unit may be snapped onto, screwed onto, or otherwise attached to, the upper portion of the beverage container in its specified beverage holding orientation. This connector unit is designed so the collar of the food holding receptacle of the present invention is comfortably and stably mountable on the connector unit that is attached to the beverage container. This method of using the receptacle is referred to as mode 3. For example, the connector unit may consist of a special lid for a frusto-conical cup where the lid attaches to the cup in a conventional manner; the upper section of the lid is designed so that it fits into the collar from below the food holding receptacle when the food holding receptacle is positioned in its first specified food holding orientation. Thus, the food holding receptacle is stably mountable on the beverage container via the connector unit.

OBJECTS AND ADVANTAGES OF THE INVENTION

The primary object of the present invention is to provide a universal food holding receptacle that facilitates dining in stand-up and similar situations by supporting both the receptacle and any of a wide variety of beverage containers of diverse shapes and sizes by a single hand simultaneously while dining or carrying the receptacle and beverage container.

Another object of the present invention is to provide a universal food holding receptacle that is comfortably and stably mountable on beverage containers of a wide variety of shapes and sizes, such as bottles, cans, stemware glasses, non-stemware glasses, cups and mugs taken one beverage container at a time, so that the user can comfortably support both the food holding receptacle and a beverage container by a single hand in stand-up dining situations such as cocktail parties, picnics and other venues.

Another object of this invention is to provide a food holding receptacle that is stably mountable on a beverage container held in a diner's hand where the receptacle is associated with the beverage container in loose-fitting relationship so that the receptacle can be repeatedly mounted on and demounted from the beverage container in a facile manner, and where the beverage container is one of a set of beverage containers of diverse shapes and sizes.

Another object of this invention is to provide a food holding receptacle as described in the two previous paragraphs that is alternatively capable of stably supporting beverage containers of diverse shapes and sizes taken one beverage container at a time.

Another object of the present invention is to provide a food holding receptacle that is mountable on a connector unit which in turn is attachable to the upper portion of a beverage container thereby allowing the food holding receptacle to be stably supported by the beverage container.

Another object of the present invention is to provide an arrangement whereby a food holding receptacle can be repetitively stably mounted on and demounted from a beverage container where the beverage container is one of a wide variety of beverage containers of diverse shapes and sizes in a facile manner, where the beverage container is held in a user's hand, and where the arrangement prevents beverage from being spilled and food from being tossed off the receptacle during such mounting and demounting.

Another object of the present invention is to provide a food holding receptacle that is stably mountable on a beverage container and that is readily rotated about the axis of said container while the receptacle is stably mounted on the beverage container.

Another object of this invention is to provide a combination of a plate, a bowl, a dish or a tray in association with a beverage container that facilitates eating from the plate, bowl, dish or tray and drinking from the beverage container while dining in a stand-up situation.

Another object of the present invention is to provide a universal food holding receptacle that is stably mountable on beverage containers of diverse shapes and sizes taken one beverage container at a time and that is more acceptable to the consumer than prior art devices used to facilitate dining in stand-up situations.

Another object of the invention is to provide a food holding receptacle having a base where food can be served to advantage on either surface of the base.

Another object of the present invention is to provide a food holding receptacle as described in any of the objects stated above where the receptacle is stackable on another identical receptacle.

BRIEF DESCRIPTION OF THE DRAWINGS

FIG. 3A: Receptacle mounted on a bottle

FIG. 3B: Receptacle mounted on a can

FIG. 3C: Receptacle mounted on a stemware glass

FIG. 3D: Receptacle mounted on a non-stemware glass

FIG. 3E: Receptacle mounted on a mug

REFERENCE NUMERALS IN DRAWINGS

Figure 1:
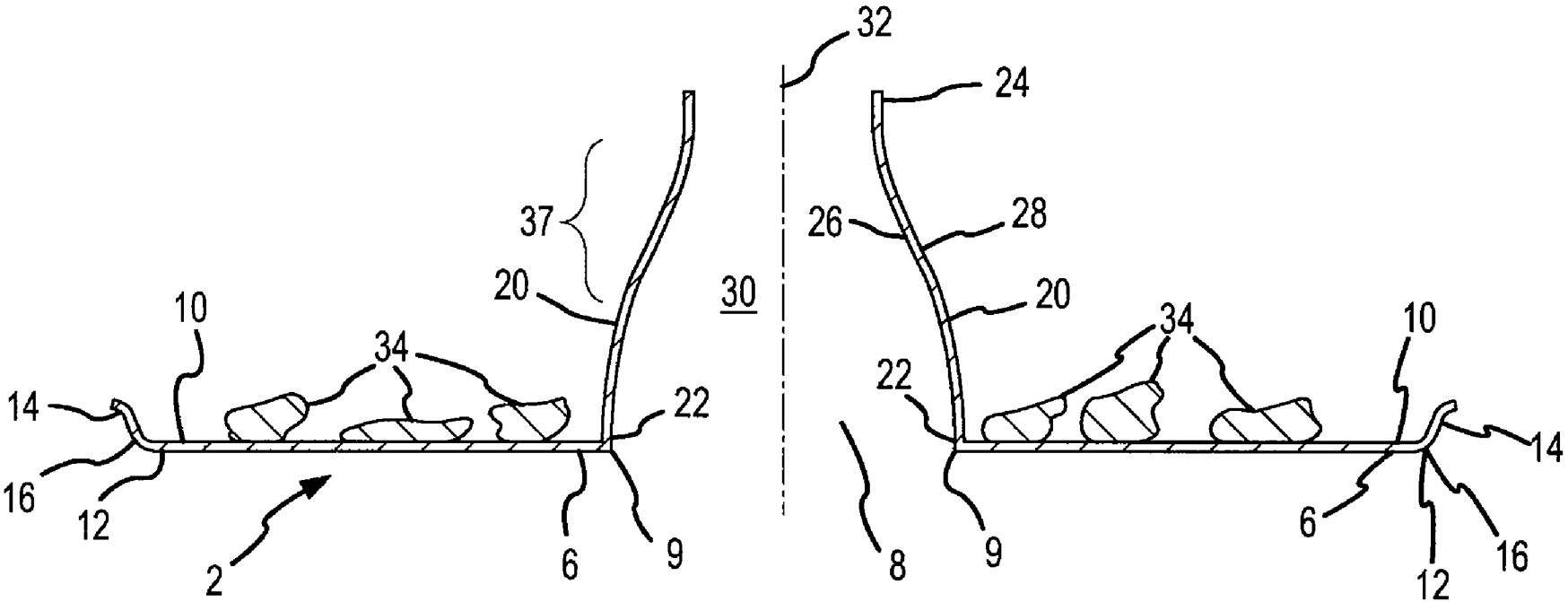
FIG. 1 shows a side view of an embodiment of the food holding receptacle of the present invention in the orientation as used in mode 1.

The food holding receptacle of the present invention is illustrated as a plate or as a bowl in the drawings

2. Plate (one of several forms of the food holding receptacle of the present invention)
4. Bowl
6. Base
8. Hole in base of food holding receptacle
9. Perimeter of hole 8
10. First surface of base
12. Second surface of base
14. Rim
16. Outer edge of base
20. Collar
22. First end of collar (adjacent base 6)
24. Second end of collar
26. Inner surface of collar
28. Outer surface of collar
30. Chamber of collar
32. Imaginary axis
34. Food items
36. Bottle
37. Constriction in collar
38. An upper portion of beverage container
39. Cylindrical collar with fins
40. Fin
41. Another embodiment of food holding receptacle
44. Bottom portion of beverage container
47. Can
48. Stemware glass
49. Non-stemware glass
51. Mug
52. Frusto-conical cup
53. Barrier on receptacle
54. First segment of barrier 53
56. Second segment of barrier 53
58. Apex of barrier 53
59. Another embodiment of rim
60. First segment of rim 59
62. Second segment of rim 59
64. Apex of rim 59
65. Popcorn
66. Connector unit
70. Upper portion of connector unit
72. Lower portion of connector unit
74. Aperture in an otherwise closed end of connector unit 66
76. Collar insert
78. Another embodiment of food holding receptacle
80. Another embodiment of collar
82. Another embodiment of the food holding receptacle
84. Cylindrical segment surrounding hole 8 and extending from surface 12
86. Cylindrical segment near outer edge of receptacle and extending from surface 12

DETAILED DESCRIPTION OF THE PREFERRED EMBODIMENTS

The food holding receptacle of the present invention is described and illustrated primarily in terms of a plate 2 in this disclosure even though the invention may take other forms such as a bowl 4, bucket, dish, tray, or other item intended for holding food by a diner. There are three possible modes for using the food holding receptacle of the present invention. In mode 1 the food holding receptacle in its first specified food holding orientation is stably mounted on a beverage container directly, and the user grasps the beverage container by a single hand. Some embodiments of the invention may also be used in mode 2 wherein a beverage container is stably supported on the food holding receptacle in its second specified food holding orientation; in this case, the food holding receptacle is held by a single hand. In mode 3, the food holding receptacle is stably mounted on a connector unit and a lower portion of the connector unit snaps, or otherwise firmly connects, onto the upper portion of the beverage container; the diner grasps the beverage container by a single hand as in mode 1.

FIG. 1 shows a side view of one embodiment of the present invention with the universal food holding receptacle in the orientation as used in mode 1, that is, in its first specified food holding orientation. Plate 2 (and other food holding receptacles of this invention) has a base 6. A hole 8 penetrates base 6 of plate 2 (or other food holding receptacle) producing an inner edge in base 6; this inner edge constitutes the perimeter 9 of hole 8. Adjacent hole 8 is a first surface 10, and on the opposite side of surface 10 a second surface 12. In FIG. 1 plate 2 is oriented such that first surface 10 is upward facing, and second surface 12 is downward facing. Plate 2 also has a rim 14 at its outer edge 16; rim 14 is oriented upwardly in FIG. 1. If plate 2 is placed on a table or other flat support in the first specified food holding orientation (i.e. with first surface 10 facing upward) then at least part of second surface 12, which is downward facing, comes into contact with the upper surface of the table or other flat support.

Figure 2:
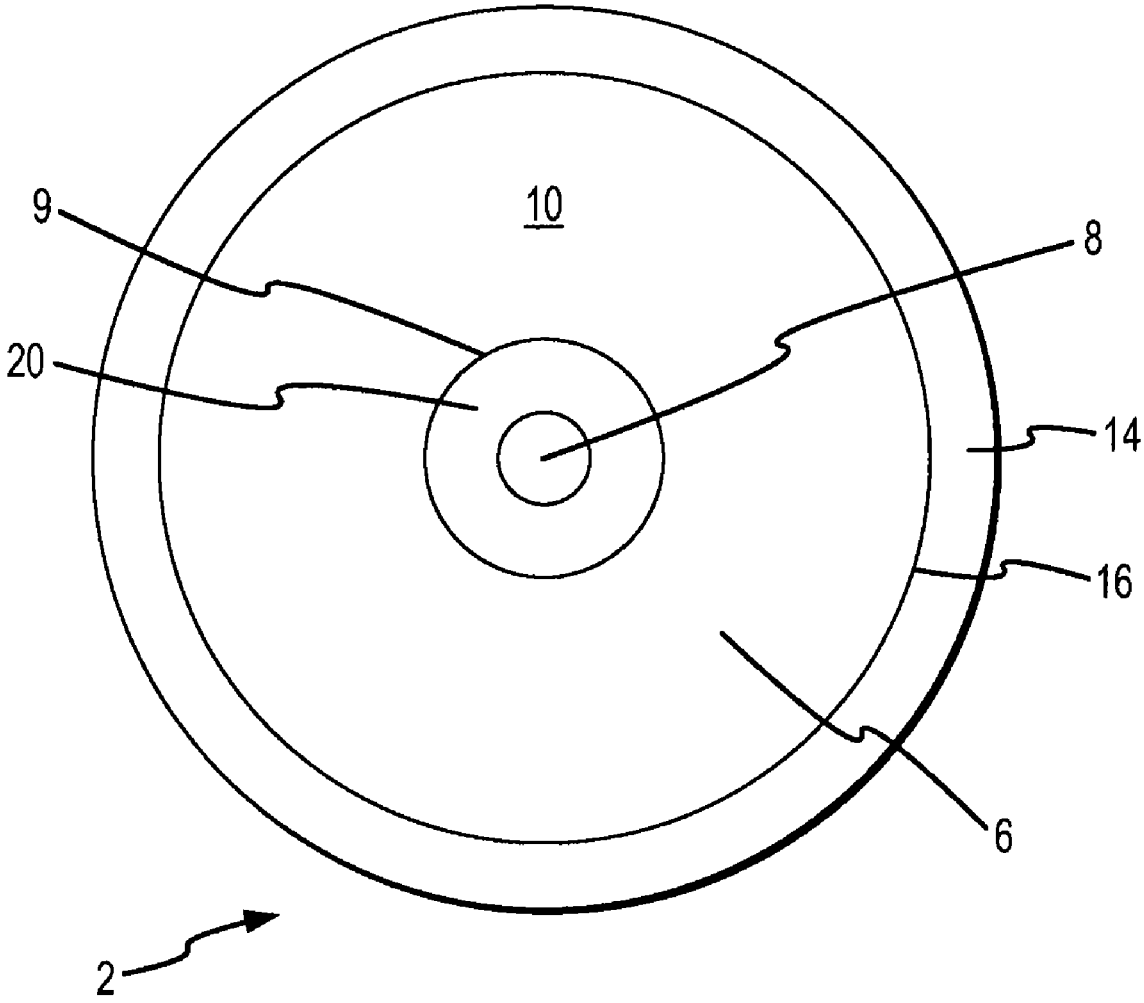
FIG. 2 shows a top view of the embodiment shown in FIG. 1.

In a preferred embodiment, as illustrated further in FIG. 2, plate 2 is circular. Other plate shapes are also possible with this invention, such as oval, rectangular, square, triangular, polygonal, dumbbell, and so on. In the embodiment shown in FIGS. 1 and 2, hole 8 is centrally and symmetrically located in circular plate 2. In other embodiments, hole 8 may be located off-center. When base 6 and hole 8 are circular and arranged as shown in FIG. 2, base 6 is annular in shape. Protruding upwardly from base 6, in the first specified food holding orientation as shown in FIGS. 1 and 2, is a collar 20. Collar 20 consists of a hollow tubular segment having a first end 22, a second end 24, an inner surface 26, an outer surface 28, and a chamber 30. First end 22 of collar 20 may be congruent with and attached to perimeter 9 of hole 8 (as shown in FIG. 2). Alternatively, first end 22 of collar 20 could have a diameter greater than that of perimeter 9; in such a case first end 22 would not be superimposed on perimeter 9 but would closely surround perimeter 9 while attached to base 6. Second end 24 of collar 20 is distal to first end 22. The dotted line in FIG. 1 shows an imaginary axis 32 perpendicular to base 6 of plate 2 and passing centrally through hole 8 that is centrally located in base 6 of plate 2. Rotation of the line drawing of plate 2 in FIG. 1 about axis 32 generates the complete plate as shown from the top view in FIG. 2 (in the case of this centrosymmetric embodiment). First surface 10 (upward facing in FIGS. 1 and 2) of base 6 constitutes a first food holding section of plate 2, and food items 34 are placed on this first food holding section (first surface 10). Food items 34 may consist of solid items and may also contain fluid items such as gravy or sauce. Rim 14 prevents food items 34 from falling off outer edge 16 of plate 2, and collar 20 prevents food items 34 from falling into hole 8 in base 6 of plate 2.

Figure 3A:
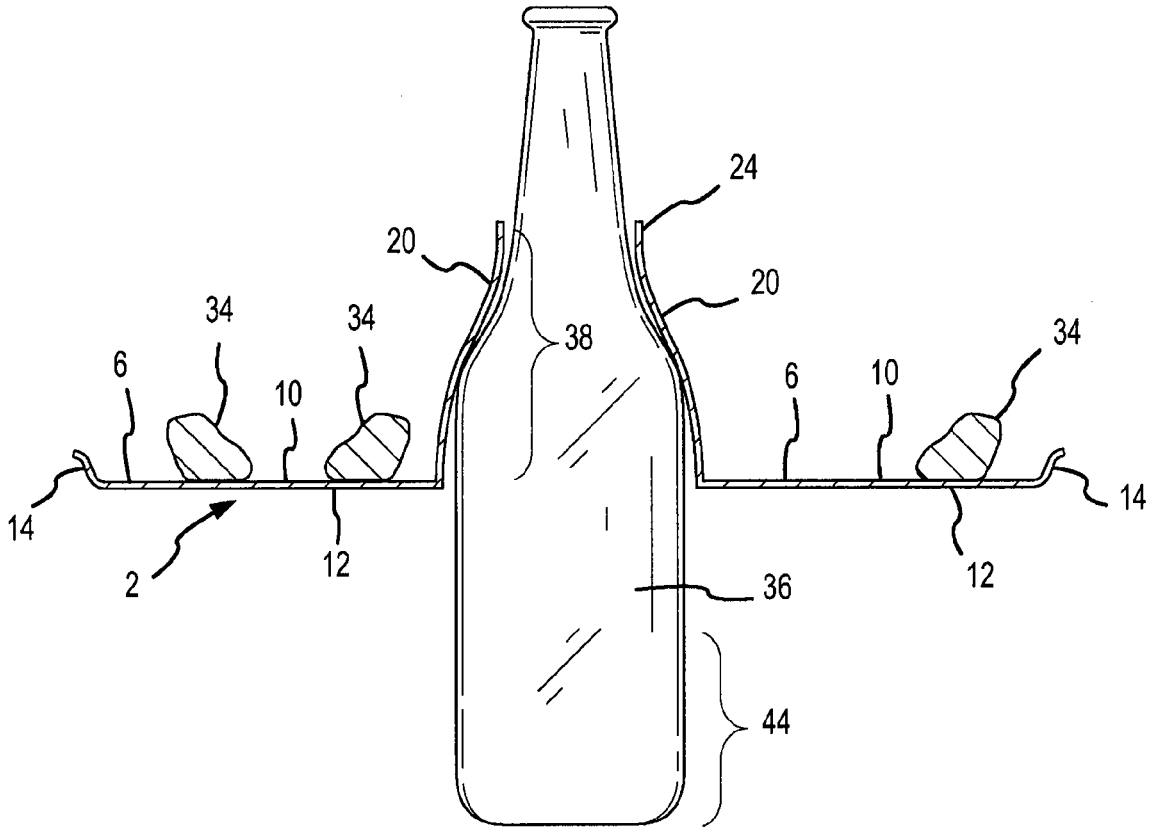
FIGS. 3A through 3E show side views of a single version of the embodiment of FIG. 1 mounted separately on each of a variety of beverage containers of diverse shapes and sizes according to mode 1 of the invention.
Figure 3B:
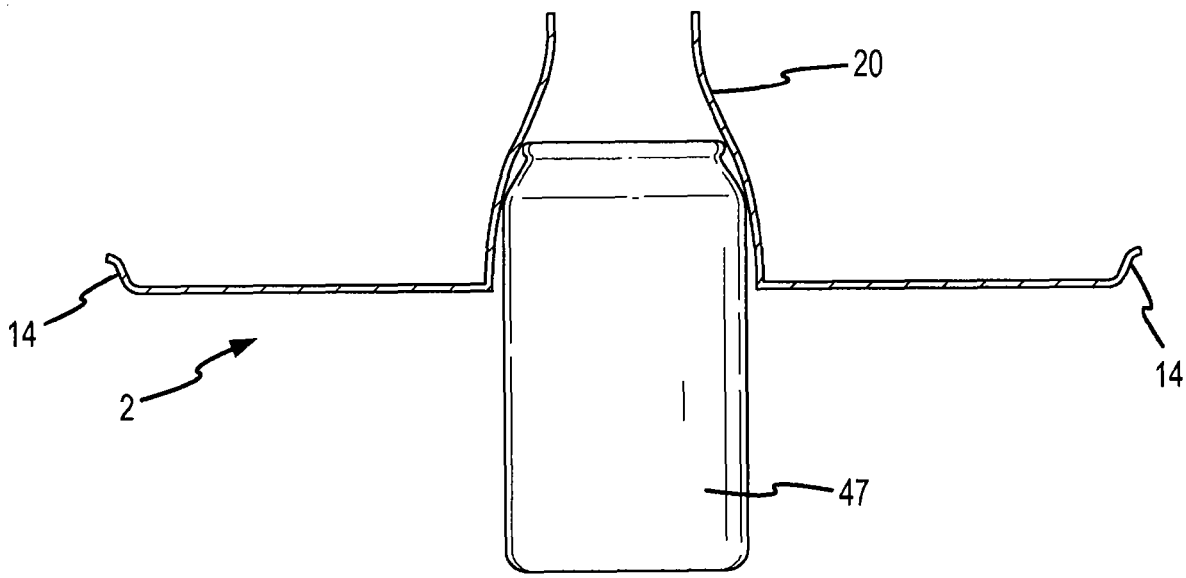
Figure 3C:
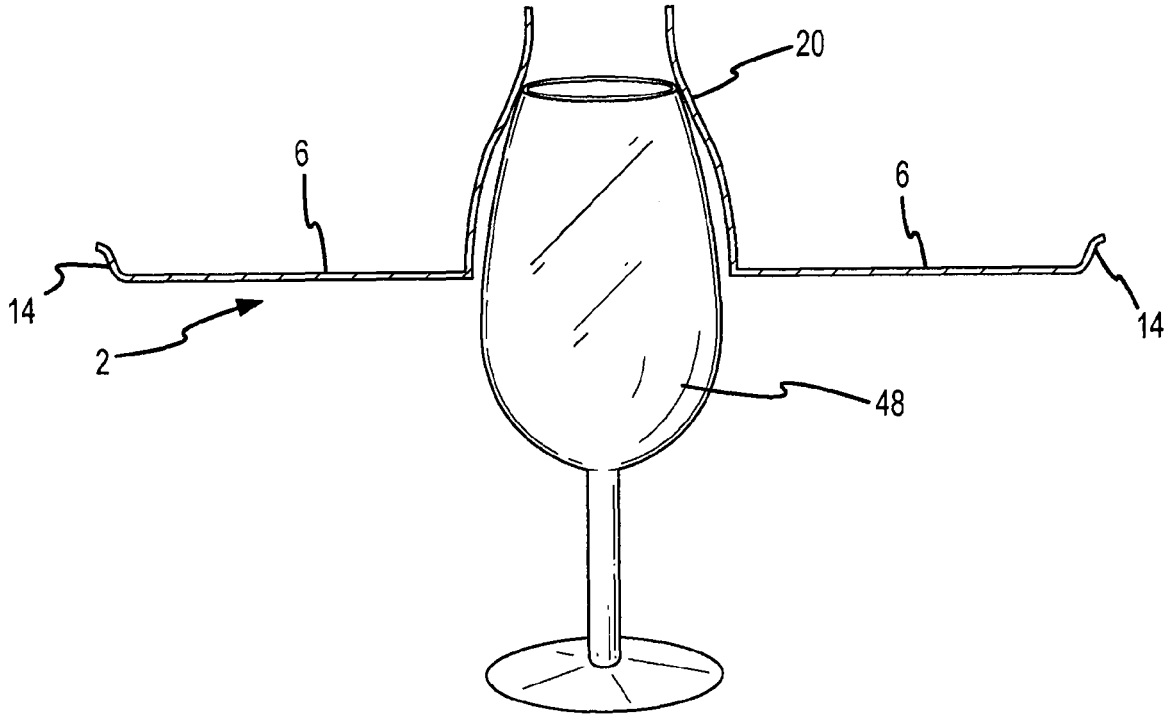
Figure 3D:
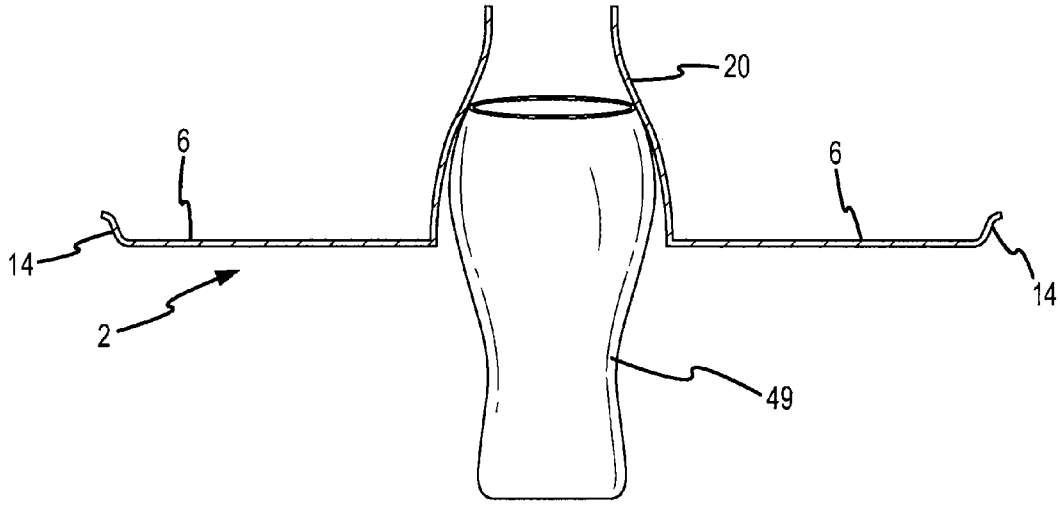
Figure 3E:
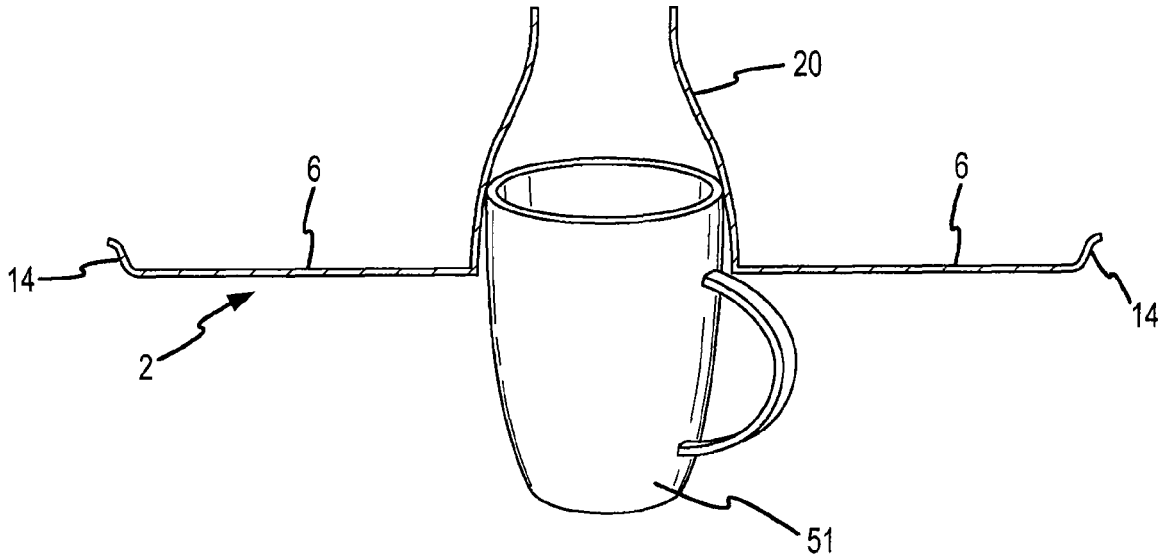
Figure 4:
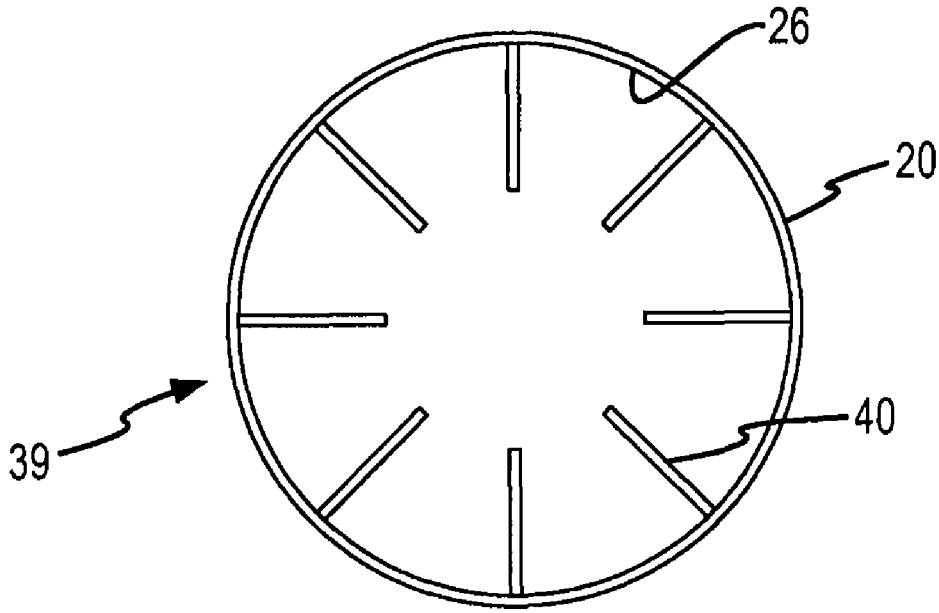
FIG. 4 shows a top view of an alternative embodiment of the collar having fins extending from inner surface of collar.
Figure 5:
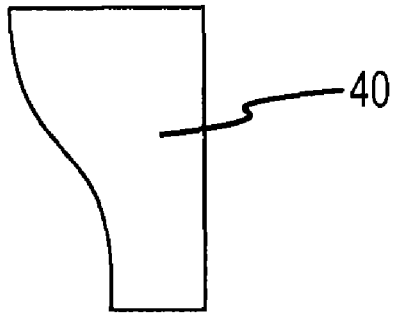
FIG. 5 shows a side view of one of the fins in FIG. 4.

Plate 2 is intended for use in association with beverage containers such that by holding plate 2 in its first specified food holding orientation, collar 20 can be placed over and around upper portion 38 of a beverage container that is positioned in its specified beverage holding orientation. This is shown in FIG. 3A where the beverage container is a bottle 36. Bottle 36 is inserted through hole 8 and into chamber 30 of plate 2 from the underside of plate 2 (hole 8 and chamber 30 are shown in FIG. 1). First end 22 of collar 20 is coincident with perimeter 9 of hole 8 in base 6 (for the embodiment illustrated in FIG. 1). Referring to FIGS. 1 and 3A where the receptacle is in its first specified food holding orientation, collar 20 has a narrower cross section (i.e. narrower than cross section of first end 22 and hole 8) upward from base 6; this narrowing creates a constriction 37 (see FIG. 1) in collar 20. This constriction prevents the beverage container (bottle 36 in the case of FIG. 3A) from being able to pass completely through collar 20 (when the beverage container is inserted into hole 8 from below base 6 in the arrangement of FIG. 3A) and allows plate 2 to rest on part of the outer surface of bottle 36. Other means for preventing the complete passage of a beverage container through collar 20 are possible, such as having fins or baffles protruding inwardly from the inner surface of the collar as shown in FIG. 4. The term restricting means will be used to describe any form of restriction or constriction that prevents the complete passage of a beverage container through hole 8 when the beverage container is inserted into hole 8. For example, FIG. 4 shows a top view of a cylindrical collar 39 with fins 40 protruding from the inner surface of the collar and directed toward the axis of the cylindrical collar. FIG. 5 shows a side view of one such fin 40. Sections of a given fin extend an increasing distance from inner surface 26 toward the cylinder axis as a function of distance from base 6 of plate 2 thereby creating a restricting means to obstruct the passage of a beverage container through collar 39 after passing through hole 8. Other forms of restricting means are also possible. For beverage containers with upper portions of larger dimensions, the perimeter 9 (see FIGS. 1 and 2) itself may serve as the restricting means.

The food holding receptacle of the present invention is freely mountable on beverage containers, meaning that: the arrangement is free of any form of active engagement (such as a press-fit, snap-on, screw-on, twist-on, tongue-in-groove or other such type of specific connection) between the receptacle and container; the receptacle is free of any appendage depending from the receptacle for gripping by the user in order to maintain the receptacle stably mounted on the beverage container; and, for modes 1 and 3 the user does not necessarily have to touch or grip the food holding receptacle in order to achieve the stable mounting. When the food holding receptacle of the present invention is stably and loosely mounted on a beverage container the receptacle suspends from upper portion 38 of the beverage container where the suspension region of inner surface 26 of collar 20 is in contact with part of upper portion 38 of the beverage container. The center of gravity of the receptacle when mounted on the beverage container generally lies below the suspension region, and this contributes to the stable mounting of the receptacle on the beverage container.

Referring to FIG. 3A, by gripping bottle 36 by a first hand in a region proximal bottom portion 44 of the bottle, a user can hold support bottle 36 and plate 2 that is resting on bottle 36 by a single hand. This allows the diner to use his or her second hand for removing food items 34 from plate 2. When the diner wishes to drink some of the beverage in bottle 36 he/she simply grasps plate 2 by the second hand, separates plate 2 from bottle 36 that is held in the first hand, and drinks from bottle 36. This process is continued by replacing plate 2 on bottle 36 and repeating the steps. This invention allows a person to dine comfortably in stand-up and similar situations and to avoid the awkwardness generally associated with simultaneously holding a plate of food and a beverage container at cocktail parties, other such stand-up functions, and at other venues where a table is not readily available. Separation of mounted plate 2 from bottle 36 is accomplished simply by translating plate 2 upward and/or bottle 36 downward relative to the other component.

Mounting plate 2 on the beverage container and separating plate 2 from the beverage container are both facile operations. No pressing or pulling is required in, respectively, mounting the food holding receptacle on, and in demounting the receptacle from, the beverage container. The beverage container serves as a handle for firmly and comfortably holding plate 2 when the plate is supported on the beverage container. The plate is not easily dislodged from the beverage container if someone bumps into or jolts the person holding the beverage container with plate 2 supported thereon. Nevertheless, plate 2 can be instantly removed from the beverage container by simply lifting plate 2 upward using one hand while holding the lower portion of the beverage container by the other hand.

The loose-fitting relationship between the food holding receptacle of the present invention and the beverage container upon which the receptacle is mounted allows preferred embodiments of the receptacle to be readily rotated, about a vertical axis, relative to the beverage container while the receptacle is mounted on the beverage container. This feature is advantageous when dining as it allows a diner to readily rotate the plate while mounted on the beverage container so that he or she has access to food items on all parts of the receptacle's first specified food holding surface without having to release his or her grip on the beverage container. This is a simpler operation than rotating the beverage container.

If one wishes to leave the plate on a table or other support, the plate in its first specified food holding orientation is stably supportable on a flat surface after demounting it from the beverage container. In some cases, the plate may also be left on a table while supported on a beverage container.

During experimentation in the development of the present invention it was discovered that by forming inner surface 26 of collar 20 with special shapes and dimensions, a given plate 2 (in its first specified food holding orientation) is capable of being stably and comfortably supported on a variety of beverage containers of widely diverse shapes and sizes, taken one beverage container at a time. More specifically it was discovered that by proper choice in the design of plate 2, particularly in the design of inner surface 26 of collar 20, a single plate 2 is comfortably mountable on: a variety of bottles 36 of widely different shapes and sizes; a variety of cans 47 of different shapes and sizes; a variety of stemware glasses 48 of different shapes and sizes; a variety of non-stemware glasses 49 of diverse shapes and sizes; and a variety of cups and mugs 51 of different shapes and sizes. In this context (and also in view of mode 2 of using the receptacle of the present invention as discussed below) the food holding receptacle, and in particular the collar, can be considered universal in terms of its compatibility with such a diverse range of beverage containers. The prior art does not disclose a satisfactory universal plate suitable for stably mounting on beverage containers of widely diverse shapes and sizes as described herein.

FIGS. 3B, 3C, 3D, and 3E show plate 2 of FIG. 3A in its first specified food holding orientation alternatively mounted on a can 47, a stemware glass 48, a non-stemware glass 49, and a mug 51, respectively. While FIGS. 3A-3E show a single example of each type of beverage container (a bottle, a can, a stemware glass, a non-stemware glass, and a mug), embodiments of the plate of the present invention are comfortably and stably mountable on: many different types of bottles of diverse shapes and sizes taken one bottle at a time; several cans of diverse shapes and sizes taken one can at a time; a wide variety of stemware glasses of diverse shapes and sizes taken one glass at a time; a wide variety of non-stemware glasses of diverse shapes and sizes taken one glass at a time; a variety of cups of diverse shapes and sizes taken one cup at a time; and a variety of mugs of diverse shapes and sizes taken one mug at a time. The food holding receptacle of the present invention is equally applicable to open or closed beverage containers such as bottles, cans, etc.

Figure 6:
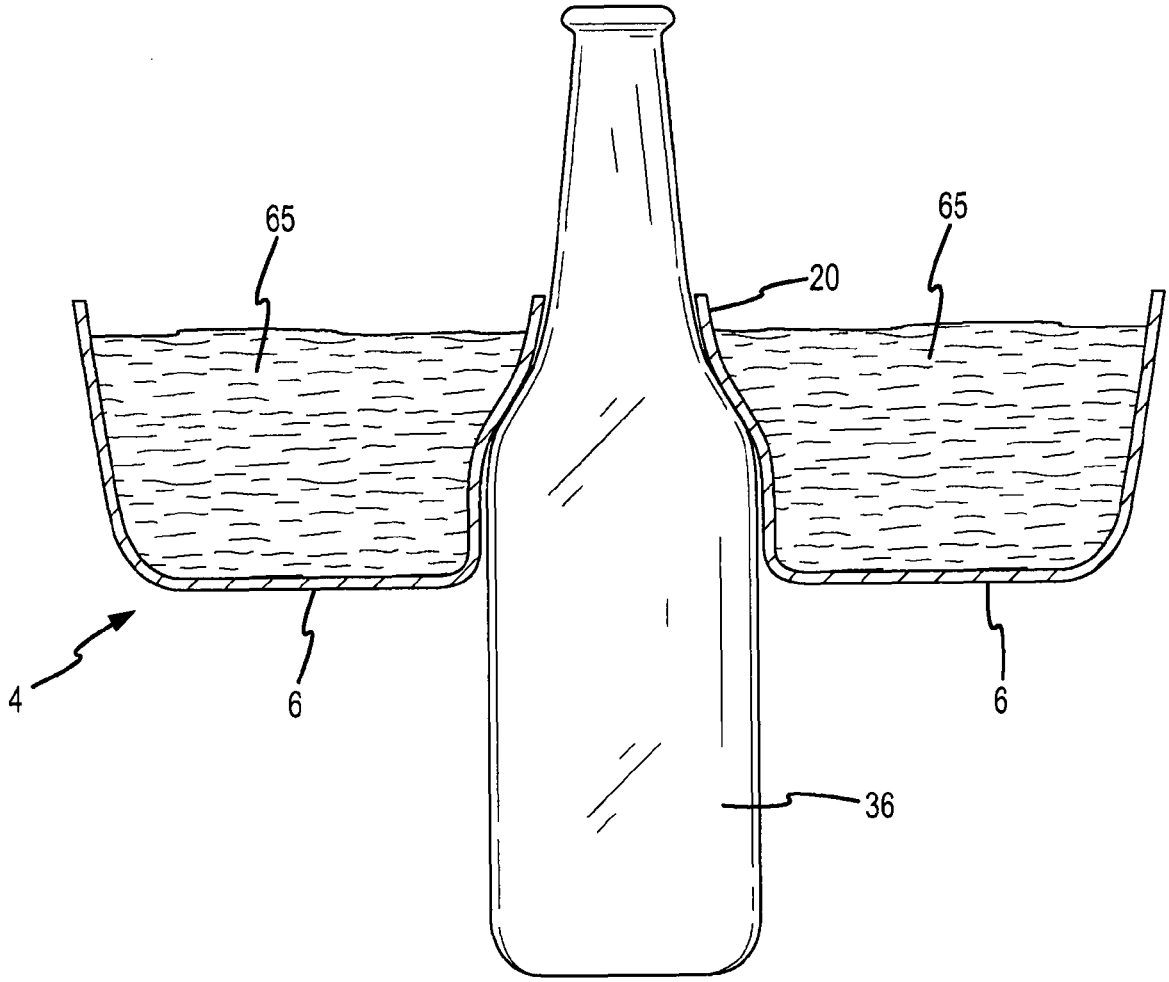
FIG. 6 shows a side view of an embodiment of the food holding receptacle of the present invention in the form of a bowl mounted on a bottle.

The top of some beverage containers (particularly some bottles) may protrude from second end 24 of collar 20 when the receptacle is mounted on the beverage container, as shown in FIG. 3A for a bottle. In other cases, the beverage container does not protrude through second end 24 of collar 20, as shown for a can in FIG. 3B. The food holding receptacle of the present invention could be in the form of a dish, tray, bucket, or bowl where the dish, tray, bucket, or bowl is supported on any of a wide variety of beverage containers such as bottles 36 or cans 47 taken one beverage container at a time. FIG. 6, for example, shows a bowl 4 for holding soup, dessert, popcorn 65 or other food items mounted on bottle 36.

Figure 7:
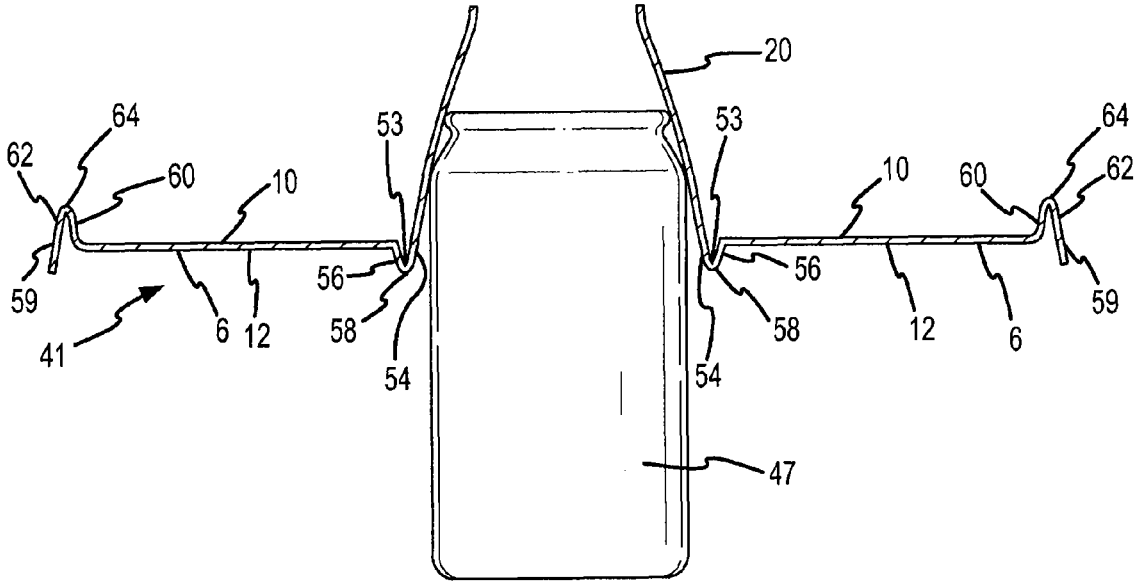
FIG. 7 shows a side view of another embodiment of the food holding receptacle of the present invention mounted on a can according to mode 1 of the invention.
Figure 8:
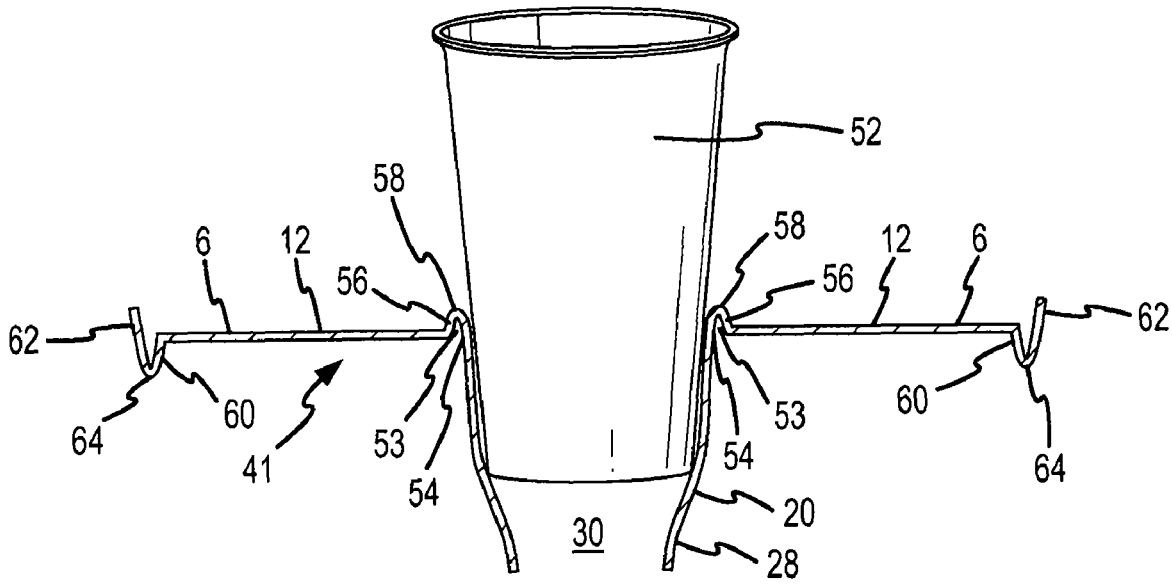
FIG. 8 shows a side view of the receptacle from FIG. 7 supporting a frusto-conical cup according to mode 2 of the invention.

FIG. 7 shows another embodiment 41 of the food holding receptacle of the present invention mounted on a beverage container (mode 1), and FIG. 8 shows this same embodiment supporting a beverage container (mode 2). FIGS. 7 and 8 illustrate another embodiment of rim 59. Rim 59 in FIGS. 7 and 8 comprises a first segment 60 and a second segment 62 joined at apex 64. First segment 60 prevents food from falling off first surface 10 when plate 41 is in its first specified food holding orientation, and second segment 62 prevents food from falling off surface 12 when plate 41 is in its second specified food holding orientation. Other rim designs for preventing food from falling off either surface of a base when that surface is facing upward are also possible. An alternative approach is to use a rim 14 as illustrated in FIG. 1 where the rim is invertible such that in one case rim 14 is oriented upward with respect to surface 10 (in mode 1) and in another case rim 14 is inverted or flipped such that it is oriented upward with respect to surface 12 (in mode 2).

Up to this point in the disclosure, the food holding receptacle has been discussed primarily as used in mode 1, that is, the receptacle is positioned in its first specified food holding orientation with first surface 10, functioning as a first food holding section, facing upward (FIGS. 1, 2, 3A-3E, 7). Embodiment 41 of the food holding receptacle shown in FIG. 7 in its first specified food holding orientation is also suitable for use in mode 2 where receptacle 41 is positioned in its second specified food holding orientation as shown in FIG. 8. The second specified food holding orientation of plate 41 as shown in FIG. 8 is obtained by rotating plate 41 essentially 180° about a horizontal axis relative to the first specified food holding orientation shown in FIG. 7. In FIG. 8 second surface 12 is facing upward and functions as a second food holding section. Embodiment 41 of the plate oriented as shown in FIG. 8 can stably hold and support a beverage container in its specified beverage holding orientation within chamber 30 of collar 20, as illustrated with a frusto-conical cup 52 in FIG. 8. Plate 41 shown in FIG. 8 has all the capabilities already disclosed herein in relation to mode 1, and is also capable of comfortably and stably holding a beverage container within chamber 30 of collar 20, as shown (mode 2). The depth to which frusto-conical cup 52 enters collar 20 (FIG. 8) is determined either by (1) the cross section of hole 8 or (2) the location of the constriction in the collar. That is, the restricting means may be the cross section of hole 8 or it may be part of the inner surface 26 of collar 20. In this case, the user grasps outer surface 28 of collar 20 by a single hand thereby supporting both plate 41 and beverage container 52 (FIG. 8). In this mode of operation (mode 2) collar 20 acts as a handle for stably and comfortably supporting plate 41 with frusto-conical cup 52 supported thereon. Cup 52 is not easily dislodged from plate 41 if someone bumps into or jolts the person holding the receptacle with the cup supported thereon. This is true also for other types of beverage containers. The beverage container can be instantly removed from the food holding receptacle by simply lifting the beverage container upward using one hand while continuing to grip the food holding receptacle by the other hand.

According to mode 2 of using the food holding receptacle of the present invention, the user holds collar 20 in a first hand with second surface 12 facing upward. A beverage container such as frusto-conical cup 52 is inserted into chamber 30 of collar 20. Items of food are placed on second surface 12 either before or after the beverage container is placed in chamber 30 of collar 20. In mode 2, second surface 12 functions as a second food holding section. The user can then use his or her second hand to take food items from second surface 12. When the user wishes to drink from the beverage container he or she uses the second hand to remove the beverage container from collar 20 and continues to grip the food holding receptacle by the first hand. Alternatively, a straw may be used to drink from the beverage container while it is supported on the food holding receptacle. Alternatively, if the beverage container holds a milkshake, ice-cream, salad or fruit, the contents of the container may be removed using a spoon or a fork.

The embodiment of the food holding receptacle shown in FIGS. 7 and 8 has a barrier 53 projecting from second surface 12 and extending in the opposite direction to collar 20. Barrier 53, as shown in FIGS. 7 and 8 is composed of a first segment 54 and a second segment 56 joined at apex 58 that, in cross section, resembles an inverted "V". Barrier 53 extends circumferentially around perimeter 9 that surrounds hole 8. Barrier 53 which extends upwardly in mode 2 prevents food from falling off surface 12 and into hole 8 when the receptacle is in its second specified food holding orientation as shown in FIG. 8.

For the food holding receptacle of the present invention, different parts of a given collar 20 can function as a restricting means for beverage containers of different shapes and sizes. This is evident in FIGS. 3A-3E (mode 1) and FIG. 8 (mode 2). In mode 1, upper portion 38 of a beverage container enters hole 8 until some part of the beverage container encounters a segment of collar 20 (including perimeter 9) that acts as a restriction upon which the receptacle sits. In mode 2, bottom portion 44 of a beverage container enters hole 8 until some part of beverage container encounters a segment of collar 20 (including perimeter 9) that acts as a restriction upon which the beverage container sits. Some beverage containers penetrate collar 20 a relatively small distance before encountering a restriction. Other beverage containers must penetrate the collar to a much greater extent before encountering a restriction. When the receptacle is mounted on a beverage container (mode 1), upper portion 38 of some beverage containers protrude from, and extend above, second end 24 of collar 20. The special design of collar 20 allows: (1) the receptacle to be stably mounted on beverage containers of different shapes and sizes in mode 1, and (2) beverage containers of different shapes and sizes to be stably supported on the receptacle (mode 2), even though different beverage containers penetrate the collar to quite different extents before encountering the restriction.

Because of the freely supported and loose-fitting manner in which the receptacle of the present invention is mounted on various beverage containers, the receptacle may be capable of a slight degree of wiggle while mounted on some beverage containers when the outer edge of the receptacle is gripped at one point and gently moved up and down a small distance by one's hand. This feature does not diminish the effectiveness of the invention, and does not hinder the stability of mounting. It is a consequence of the universal nature of the food holding receptacle of the present invention.

Figure 9A:
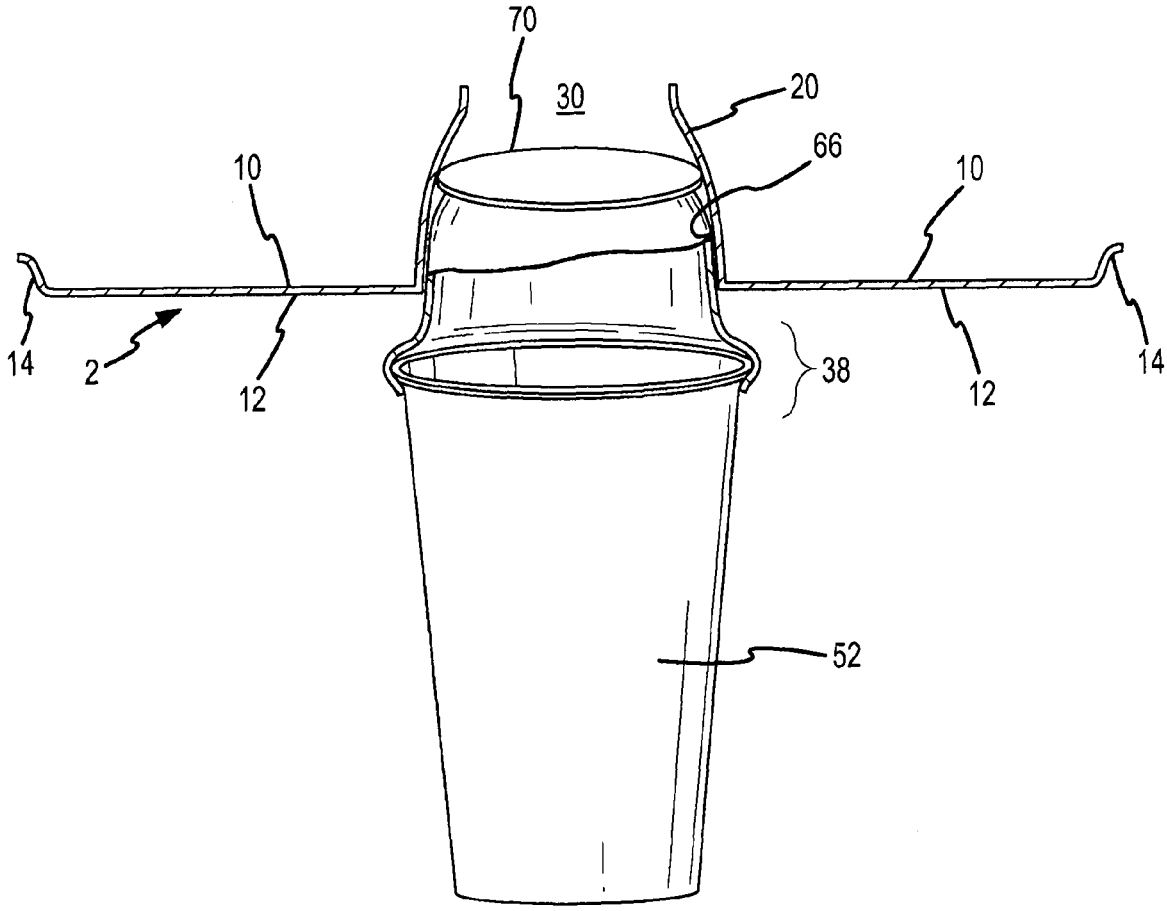
FIG. 9A shows a side view of a plate mounted on a connector unit that is attached to an upper portion of a beverage container according to mode 3 of the invention.

The food holding receptacle of the present invention may also be mounted on a beverage container via a connector unit (mode 3). In the case of mode 3 connector unit 66 is used to connect food holding receptacle 2 in its first specified food holding orientation to beverage container 52 as illustrated in FIG. 9A. In FIG. 9A connector unit 66 connects to upper portion 38 of frusto-conical cup 52 by press-fit, snapping, screwing or other means known in the prior art. Upper section 70 of connector unit 66 is adapted to fit comfortably into chamber 30 of the food holding receptacle 2 such that food holding receptacle 2 in its first specified food holding orientation is stably mountable on connector unit 66, and is thereby supported by the beverage container as shown in FIG. 9A.

Figure 9B:
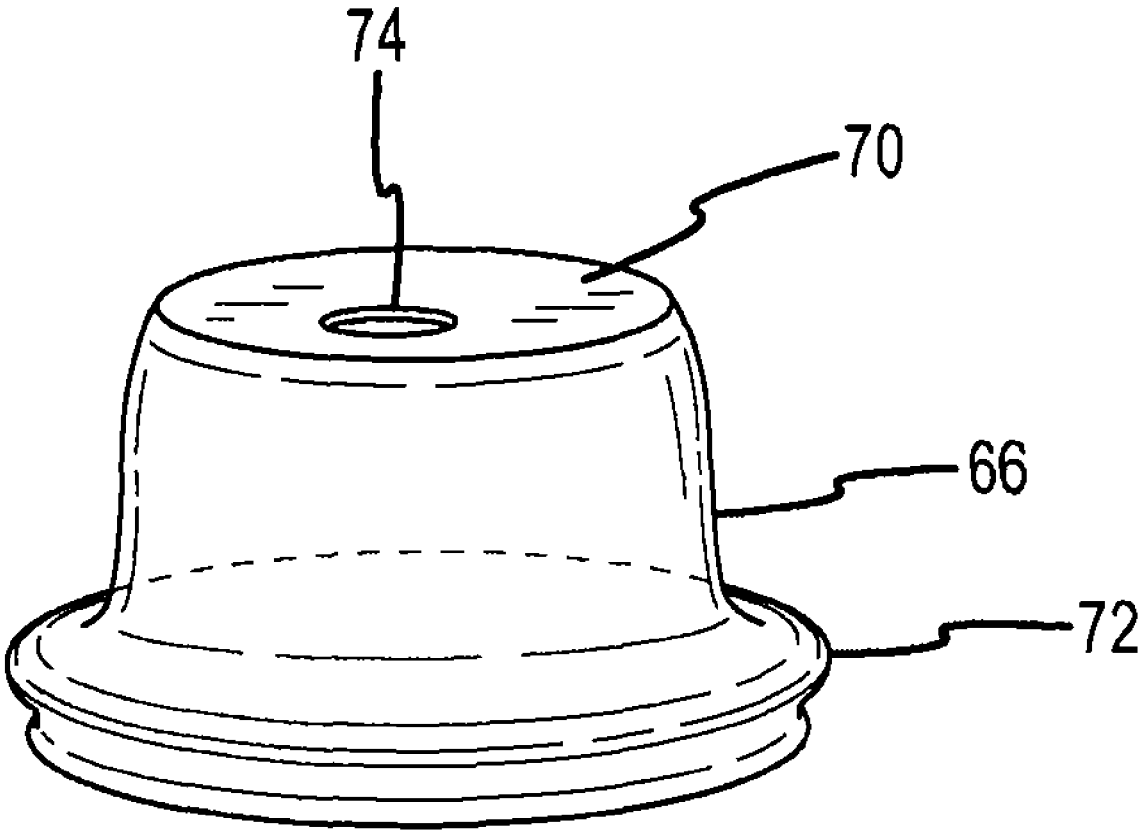
FIG. 9B shows an alternative embodiment of the connector unit.

When the food holding receptacle is mounted on connector unit 66 that is joined to upper portion 38 of the beverage container (mode 3; FIG. 9A) the food holding receptacle is operated in essentially the same manner as for mode 1. The beverage container in its specified beverage holding orientation is held by a first hand; the connector unit is attached to an upper portion of the beverage container; and the food holding receptacle in its first specified food holding orientation is mounted on the connector unit. The user takes food items from the food holding receptacle with the second hand. When the user wishes to drink from the beverage container, he/she grips the food holding receptacle by the second hand and removes the beverage container with attached connector unit from under the food holding receptacle. The user drinks from the opening in upper portion 70 of connector unit 66, and then reinserts the connector unit (attached to beverage container) into chamber 30 of the food holding receptacle. Alternatively, upper section 70 of connector unit 66 may be partly closed but with an aperture 74, as shown in FIG. 9B, through which a beverage may be consumed. Some embodiments of the connector unit may be considered as a specially designed lid for a beverage container, where the lid is characterized by its ability to be comfortably accommodated within the chamber of the collar in some embodiments of the food holding receptacle of the present invention. Connector unit 66 is constructed such that upper portion 70 is accommodated by chamber 30 and lower portion 72 has a form and dimension to properly attach to a beverage container having an upper section of given form and dimension to produce a sealed or leak-proof connection. A set of such connector units 66 with lower portions 72 of different dimensions allows the food holding receptacle of the present invention to be stably mounted on, for example, frusto-conical cups of different sizes, taken one cup at a time. The connector unit can be designed to fit in a sealed, leak-proof manner on other types of beverage containers in addition to frusto-conical cups.

In an alternative embodiment of the connector unit, the receptacle is mountable on the upper section of the connector unit in a tight fitting relationship, and the lower section of the connector unit is mountable on the upper portion of a beverage container in loose-fitting relationship. In this case, the food holding receptacle is used as follows. While the user holds the beverage container in one hand with the connector unit loosely mounted thereon, and with the receptacle tightly mounted on the connector unit, he/she uses the other hand to take food items from the receptacle. When the user wishes to drink from the beverage container, he/she removes the beverage container from underneath the connector unit and drinks from the beverage container in the conventional manner. In this case the connector unit remains attached to the underside of the food holding receptacle while the user drinks from the beverage container. The connector unit, with the receptacle mounted thereon, is then re-mounted on the beverage container.

Outer surface 28 of collar 20 may be knurled, dimpled, corrugated, or made in other ways known in the prior art to facilitate comfortable and effective gripping of outer surface 28 when the receptacle is used in its second specified food holding orientation. The contour of outer surface 28 in some embodiments of the present invention may also facilitate comfortable gripping of collar 20 by a user's hand. When the food holding receptacle in its second specified food holding orientation is supporting a beverage container, the beverage container and the food holding receptacle can be separated from each other in a facile manner.

It is because of the special collar design in the present invention that the food holding receptacle is not only stably mountable on beverage containers of diverse shapes and sizes when the receptacle is in its first specified food holding orientation, but is also able to comfortably and stably support a beverage container when the receptacle is in its second specified food holding orientation.

The food holding receptacle in its first specified food holding orientation is stably mountable on beverage containers of diverse shapes and sizes (mode 1). This stability of mounting can be demonstrated by tilting the beverage container from its specified beverage holding orientation while the food holding receptacle is mounted on the beverage container. Tilting the beverage container about a horizontal axis by as much as 70° to 85° from the specified beverage holding orientation will generally not cause preferred embodiments of the receptacle to fall off the beverage container. Beverage containers of diverse shapes and sizes are stably supportable on the food holding receptacle in its second specified food holding orientation (mode 2). Tilting the receptacle about a horizontal axis by as much as 70° to 80° from the second specified food holding orientation will generally not cause the beverage container to fall off the receptacle.

It is evident that a food holding section of the present invention could be compartmentalized, having separate compartments for holding different food items, regardless of whether the food holding receptacle is in the form of a plate, a bowl, or some other form. Reinforcements may be added to the receptacle, particularly to the base, to provide additional rigidity; methods are known in the prior art for incorporating such reinforcements. It should be further recognized that the present invention is of value not only at the moment a person is dining but also for comfortably carrying food and beverage from the point of purchase to the dining location or while dining "on the run". In mode 1, the food holding receptacle is stably mounted on the beverage container in a manner that the food holding receptacle is not readily dislodged from the beverage container when a person is making his or her way though a throng of people or going through a food line. In mode 2, the beverage container is stably supported on the food holding receptacle in a manner that the beverage container is not readily dislodged from the food holding receptacle when a person is making his or her way though a throng of people or going through a food line.

Cross sections of collar 20 parallel to base 6 and at different distances from base 6 may be circular as illustrated in FIGS. 1 and 2 (to match a circular hole 8). These cross sections may also take other forms such as triangular, square, rectangular, pentagonal, hexagonal, and in general polygonal forms (possibly with corresponding shapes and sizes for hole 8) as well as irregular forms. Thus, the inner surface of the collar may be truncated pyramidal in shape (pyramidal frustum), at least in part. In addition, the preferred embodiments illustrated in FIGS. 1 and 7 can also comfortably accommodate some beverage containers with generally square or other noncircular cross sections.

Figure 10:
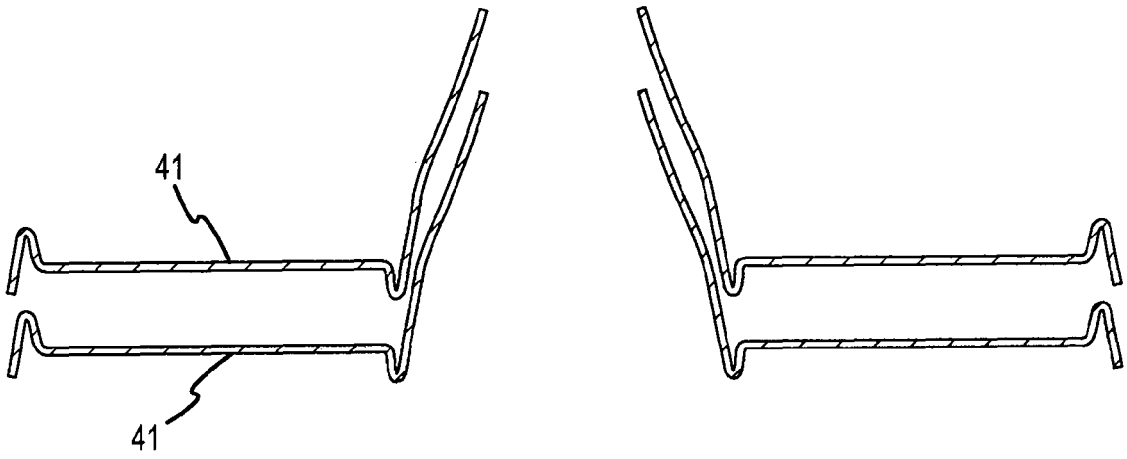
FIG. 10 illustrates the stackable nature of the food holding receptacle in FIG. 7.

The food holding receptacle of the present invention can be readily made in a stackable manner such that a plurality of receptacles can be stacked or nested together in a space-saving arrangement for storage or shipping. In designing the receptacles to be stackable, features that are well known in the prior art can be included for preventing the receptacles from nesting so closely that they stick together and are troublesome to separate. FIG. 10 illustrates the stackable nature of the food holding receptacle from FIG. 7.

Inner surface 26 of collar 20 may be generally smooth. Alternatively, inner surface 26 may be uneven, for example the inner surface may be dimpled, corrugated, stepped, ribbed (circumferential or up-down), or have some other form of unevenness.

For collars made from materials such as plastic or paper the inner surface may be somewhat resilient and have a soft texture or feel. The resiliency may be inherent to the material itself. Alternatively, the resiliency can be produced by any of a variety of methods known in the prior art, such as by having hairs, bristles, ribs, or other flexible protrusions extending from the inner surface. Bristles may be located over all of inner surface 26 of collar 20 or only in select regions such as in a circular strip at first end 22 of collar 20 close to base 6. Alternatively, velveteen or suede type textures may be used as part of inner surface 26 of collar 20. Such a soft textured or resilient inner surface 26 as discussed above serves as a contour-adjusting means allowing part of collar 20 to adapt, to some degree, to the external contours of beverage containers of different shapes and sizes. However, the universal food holding receptacle of the present invention is stably and comfortably mountable on a wide variety of beverage containers of diverse shapes and sizes even when the inner surface of the collar does not have such a resilient or contour adjusting means. A soft texture on inner surface 26 of collar 20 leads to a softer contact between the contact areas of inner surface 26 of collar 20 and the contact region of the outer surface of the beverage container upon which collar 20 is resting. Other contour adjusting means may also be used.

The versatility of the universal food holding receptacle of the present invention is of benefit to the consumer. When a consumer purchases a batch of identical plates of the type disclosed herein, the plates will be usable with bottles, cans, stemware glasses, non-stemware glasses, cups and mugs of widely diverse shapes and sizes. Prior art plates for facilitating eating and drinking in stand-up situations do not possess this type of versatility. For the food service industry, such as coffee shops and fast food restaurants, and for institutional dining and cafeterias, a given receptacle of specified dimensions could be used with a variety of frusto-conical cups of different sizes, other cups of different shapes and sizes, a wide variety of bottles of different shapes and sizes, cans of different shapes and sizes, and glasses of different shapes and sizes. For example, in a cafeteria or fast food restaurant a customer may choose to have his or her beverage in a frusto-conical cup, a can, or in any of a wide variety of bottle shapes and sizes. In each case, the beverage container will be compatible with a single version of the food holding receptacle disclosed herein. A single plate design (shape and size) is all that is needed regardless of what beverage and associated beverage container is chosen. An embodiment of the food holding receptacle disclosed herein provides a convenient and practical method of simultaneously holding popcorn or some other snack food and a beverage container in a theatre, in a stadium, on a bus, while walking down the street or through an airport, and so on. It is clear that the food holding receptacle of the present invention could also be of value when the user is seated but without the benefit of a table on which to place a plate or a beverage container.

Figure 11:
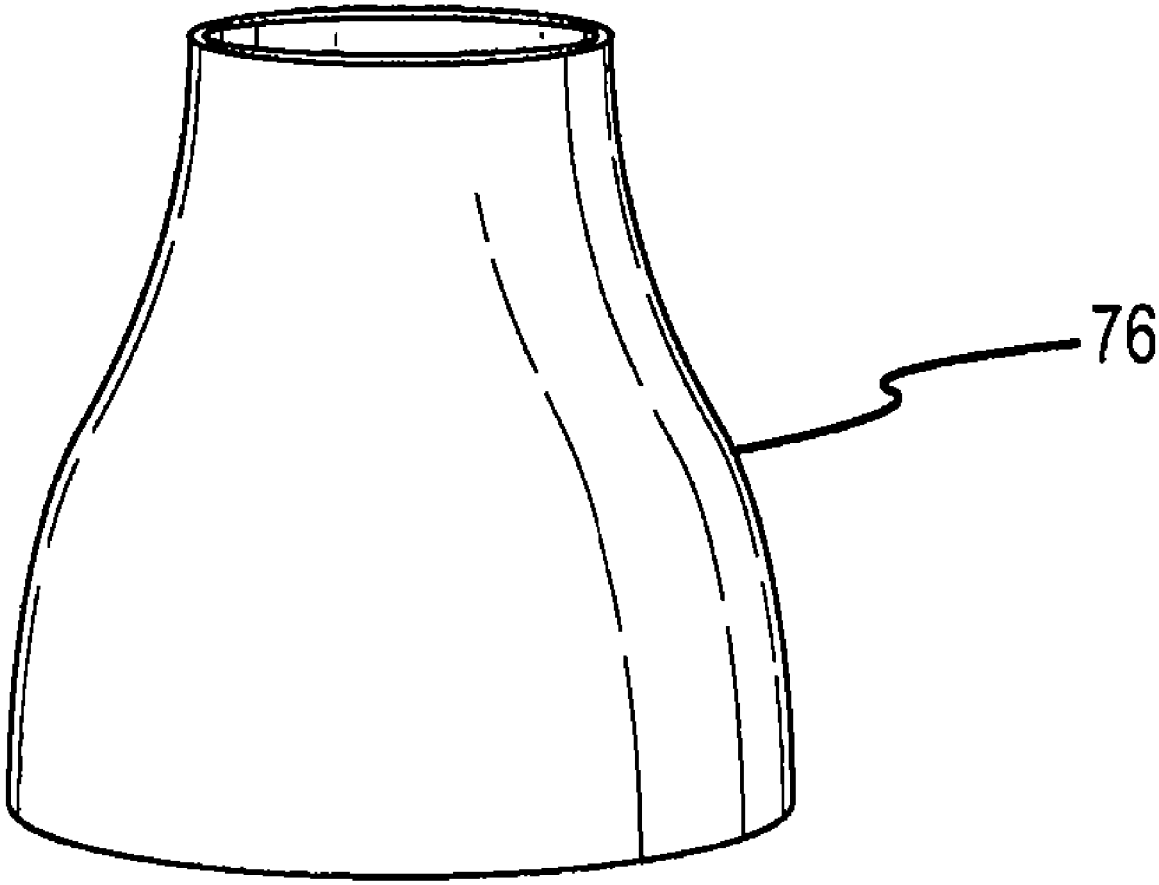
FIG. 11 shows a collar insert.

FIG. 11 shows a collar insert 76 for use with the food holding receptacle of the present invention. Such a collar insert 76 is preferably made from a soft-textured material and can be used in association with an embodiment of the food holding receptacle of the present invention particularly one that is made from hard material such as glass, ceramic, metal, or hard plastic. In this case, collar insert 76 is inserted into collar 20 of the food holding receptacle before the receptacle is mounted on a beverage container. Collar insert 76 can be removably attached to the inner surface of the collar of the food holding receptacle by any of a variety of methods that are known in the prior art. In this case, the external surface of collar insert 76 is designed to be generally complementary to inner surface 26 of collar 20 of the food holding receptacle, so that the collar insert and the collar nest or fit together comfortably. Such a collar insert cushions the contact between beverage containers and food holding receptacles, particularly those made from hard material.

Figure 12:
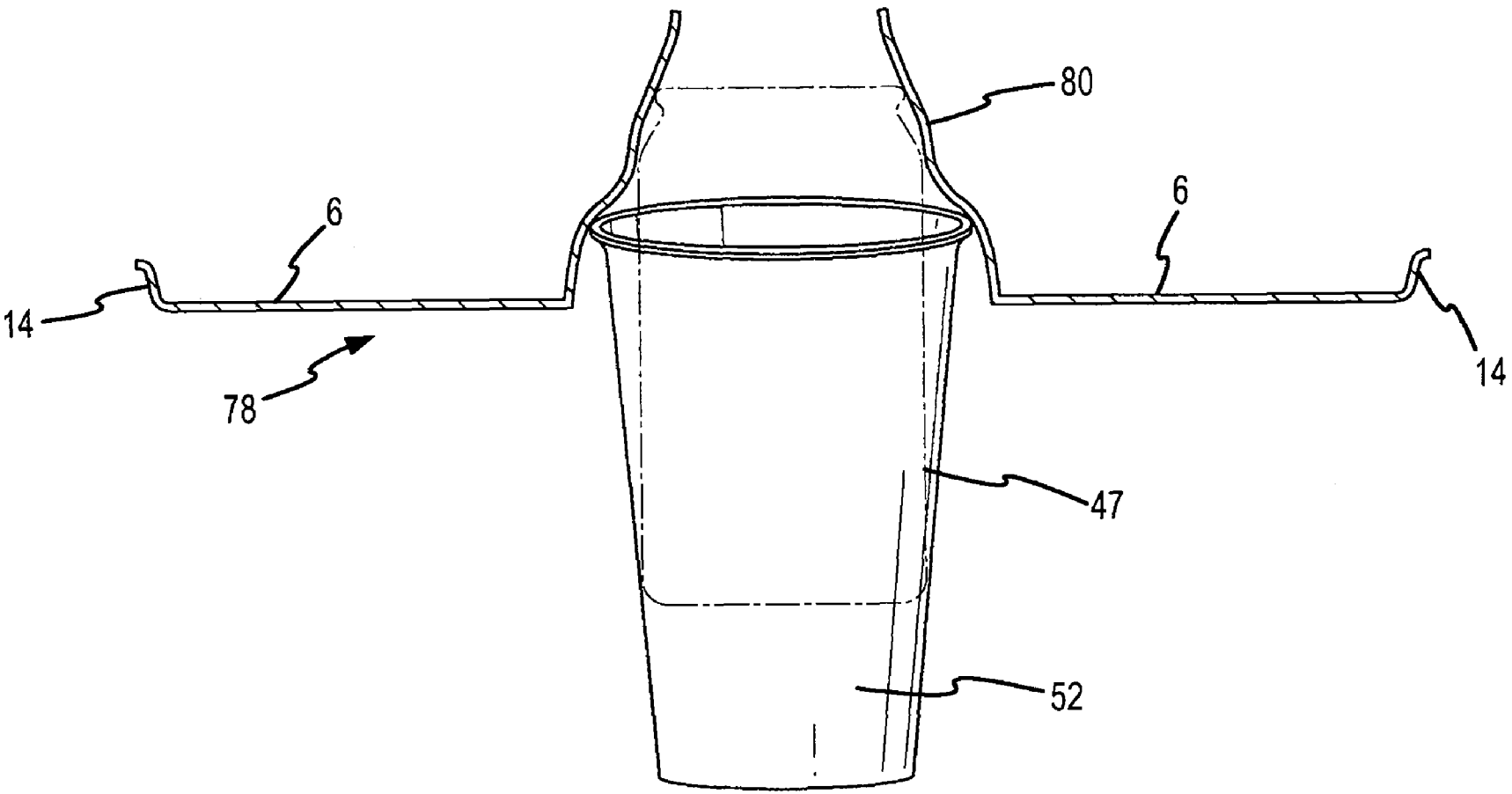
FIG. 12 shows an embodiment of the food holding receptacle of the present invention mounted on a frusto-conical cup (and alternatively mounted on a beverage can).
Figure 13A:
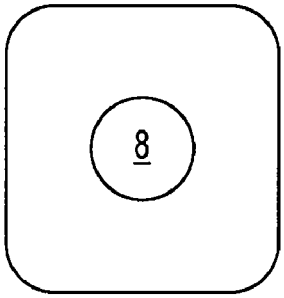
FIG. 13 shows bottom views of several food holding receptacles showing different shapes (A-F) for the bases.
Figure 13B:
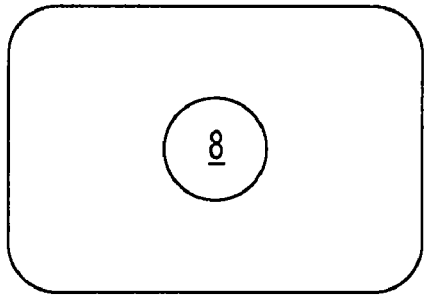
Figure 13C:
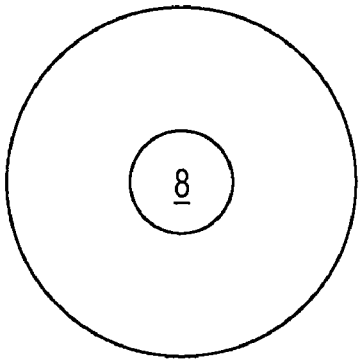
Figure 13D:
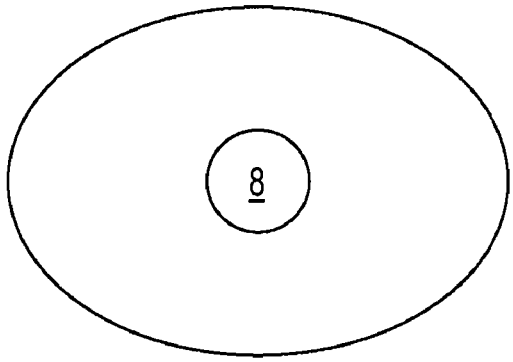
Figure 13E:
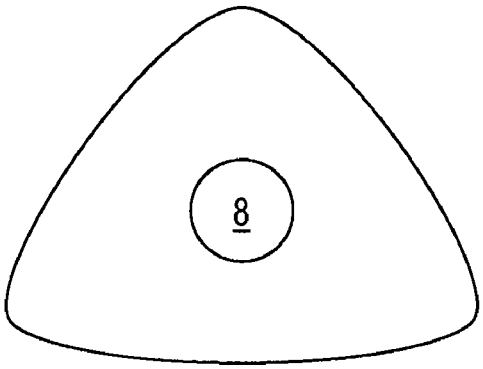
Figure 13F:
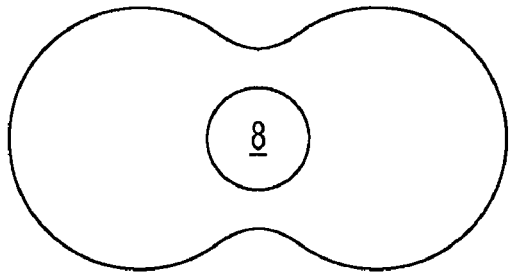

FIG. 12 shows food holding receptacle 78 in its first specified food holding orientation mounted on frusto-conical cup 52. FIG. 12 also shows this embodiment mounted on a can 47, shown in dotted outline. Collar 80 in FIG. 12 is contoured differently from collar 20 shown in the previous figures.

FIG. 13 shows bottom views illustrating several alternative shapes for base 6 of the food holding receptacle of the present invention each with a hole 8 therethrough: square (A); rectangular (B); circular (C); oval (D); triangular (E) and dumbbell shaped (F). Many other shapes for the base are possible, and hole 8 may be symmetrically or asymmetrically located on base 6.

The food holding receptacle of the present invention can be manufactured in any of several ways, for example by various forms of molding, by thermoforming, or by machining. The food holding receptacle could be made from any of a variety of materials such as plastic (foamed or unfoamed), paper, glass, wood, metal, ceramic or china. The food holding receptacle may be made of reusable ware or may be disposable. The receptacle could be manufactured in a single piece. Alternatively, the receptacle could be produced in parts which are then assembled into the complete food holding receptacle. For example, the collar and the remainder of the receptacle with the hole in its base could be manufactured separately and then joined together by any of the well known methods of joining components. It is also clear that the collar of the present invention could contain holes or gaps so long as the holes do not allow food items to fall off the food holding surface. Furthermore, the food holding receptacle of the present invention could be distributed in a form where the collar portion and the remainder of the receptacle are separate items when purchased and can then be joined together by the user. In a variation of this approach the base may not have a hole when purchased but a hole may be readily punched out by the user. The collar could consist of a band attached to perimeter 9 (and extending upwardly from first surface 10 when receptacle is in its first specified food holding orientation) with fingers extending upwardly from the band to form a restricting means.

When holding hot liquids in disposable frusto-conical cups that do not have handles it is common to use a cup holder or sleeve protector around the cup to insulate the user's hand from the heat of the cup. The need for such an accessory is diminished when supporting the frusto-conical cup on the food holding receptacle of the present invention in mode 2. In mode 2 the beverage container is held within chamber 30 of collar 20 and the user grips outer surface 28 of collar 20. Thus, collar 20 serves as a cup holder or sleeve protector to insulate the user's hand from the heat of the cup, and it is not a problem to hold the hot cup for the relatively brief period required to drink some beverage before returning the cup to the chamber. If cup holders are to be used, the diameter of hole 8 and first end 22 of collar 20 are dimensioned such that hole 8 and inner surface of collar 20 accommodate the cup holders.

It is also evident that one can print or imprint drawings, paintings and other designs on outer surface 28 of collar 20 of the food holding receptacle of the present invention. Similarly, one can provide outside surface 28 with designs in the form of three-dimensional relief. Such images and designs can enhance the aesthetic appearance of the collar and of the plate as a whole. Images on outer surface 28 may take the form of cartoon characters, animals or animal faces, action figures, or other designs that appeal to children of different ages. Logos, designs, messages and so forth can be printed or imprinted on outer surface 28 of the collar 20 in the form of greetings, or for promotional purposes, or other purposes. Outer surface 28 may also be contoured to provide an aesthetically pleasing shape to the outer surface.

EXAMPLES

While not wishing to be bound by any particular dimensions or specific shape for the food holding receptacle of the present invention, or any part or parts thereof, prototypes of the food holding receptacle of the present invention were made as described below. The materials and process for making the prototypes as described below were for the purpose of providing prototype food holding receptacles to demonstrate the efficacy of the invention and are not intended to describe how food holding receptacles of the present invention would be manufactured commercially.

Preliminary food holding receptacles with collars of many different shapes and sizes were made during initial experimentation in attempts to develop a satisfactory receptacle that was stably mountable on many beverage containers of diverse shapes and sizes, taken one beverage container at a time. The initial prototypes were fashioned from a sheet of relatively stiff cardboard having a centrally located hole and serving as the base of the receptacle. Collars of various dimensions were hand-made from aluminum foil and attached to the cardboard base surrounding the hole in efforts to produce a universal food holding receptacle. After considerable experimentation with different collar shapes and sizes and constant tweaking of the collar dimensions some suitable collars of different dimensions were arrived at. Several templates were then fabricated based on those collar dimensions. Sets of identical collars could be fashioned on each of those templates. Collars for the prototype receptacles described in the examples below were fabricated on a single such template. This template consisted of a solid, wooden, elongated (six inches) form produced on a lathe and where all regions of the template had a circular cross-section. The template has a neck, shoulder and body region and was supported on a rectangular base. The diameters of this template at specified distances from its wider end are provided in Table 1. Dimensions are specified in inches and all measurements were made with an accuracy of about ±0.03 inch. The template was designed to produce universal collars that resulted in receptacles that were stably mountable on beverage containers of widely diverse shapes and sizes.

TABLE 1

External diameter of template of height 6.00 inches at specified distances from its wider end and used to fabricate collars for the receptacles in Examples 1-5.

| Distance from Wider End (inches) | Outer Diameter (inches) |
|---|---|
| 6.00 | 1.51 |
| 5.75 | 1.52 |
| 5.50 | 1.52 |
| 5.25 | 1.53 |
| 5.00 | 1.53 |

TABLE 1-continued

External diameter of template of height 6.00 inches at specified distances from its wider end and used to fabricate collars for the receptacles in Examples 1-5.

| Distance from Wider End (inches) | Outer Diameter (inches) |
|---|---|
| 4.75 | 1.53 |
| 4.50 | 1.71 |
| 4.25 | 1.92 |
| 4.00 | 2.13 |
| 3.75 | 2.32 |
| 3.50 | 2.49 |
| 3.25 | 2.61 |
| 3.00 | 2.69 |
| 2.75 | 2.72 |
| 2.50 | 2.72 |
| 2.25 | 2.72 |
| 2.00 | 2.72 |
| 1.75 | 2.72 |
| 1.50 | 2.72 |
| 1.25 | 2.72 |
| 1.00 | 2.72 |
| 0.75 | 2.72 |
| 0.50 | 2.72 |
| 0.25 | 2.72 |
| 0.00 | 2.72 |

After testing several collar materials it was decided to make the prototype collars from aluminum foil as follows:

(i) Prototype collar blanks were prepared by wrapping a sheet of aluminum foil around the neck, shoulder and body regions of the wooden template described above and hand forming the foil by rubbing it with a rotating motion while pressing the foil to conform to the external shape of the template and by rotating the formed foil about the template. The desired collar was then cut from the blank (leaving room for the flaps discussed below) and removed from the template. The specific collar produced depends on the distances from the wider end of the template that the cuts are made. Slits, approximately 0.5 inches to about 0.75 inches in length and parallel to the axis of the collar, were cut along the wide end of the collar. These slits were spaced at distances of about 0.40 inches to about 0.60 inches apart. This operation produced a series of hinged flaps near the wide end of the collar where the effective hinges were located in the region of the slit ends distal from the wide end of the collar.

(ii) Prototype bases were made by cutting a circular hole in the food holding section of commercial disposable plates, where the diameter of the hole was equal to the external diameter of the collar near the wide end of the collar blank. Both plastic and paper plates were used in making prototype bases. Plates having bases of various shapes and dimensions were used, including circular plates with diameters of 9, 10, 10.5 and 11.5 inches; an oval plate (long dimension=12.5 inches; short dimension=10 inches); and a square plate of side=10 inches. For most prototypes the hole was centrally located on the base, but some prototypes were made where the hole was not centrally located. The food holding receptacle was then made by attaching a collar to the plate with a hole therein as follows. The narrow end of the collar was inserted into the hole in the base of the plate (from beneath the plate) until the hinges of the flaps were coincident with the perimeter of the hole. The collar was then adjusted until it was symmetrically positioned within the hole of the plate. The flaps were then bent away from the hole until they lay along or close to the underside of the plate. The flaps were then glued to the underside of the plate and the glue was allowed to dry. The assembled receptacle was then remounted on the template and rotated relative to the template to remove any dents in the collar. In some cases the outer surfaces of the collars were brushed with a light coating of PLASTI DIP to add extra strength to the collar, and after the PLASTI DIP had dried the collar or the complete receptacle was spray painted (Krylon® latex paint).

Many prototype food holding receptacles were made in this manner with collars varying in height from 2.25 inches to 3.50 inches and corresponding to different segments of the template of dimensions shown in Table 1. The inner surface of these collar blanks exactly matches the dimensions of the outer section of the template on which they were formed.

The first three prototypes described below are plates having collars 20 with dimensions as presented in Tables 2, 3 and 4. Referring to Tables 2, 3 and 4 and considering plate 2 in its first specified food holding orientation with base 6 horizontal and surface 10 facing upward (mode 1), the position of surface 10 of base 6 is defined as zero elevation and distances above surface 10 are measured vertically upwards from this level. Each table provides the height of the collar and the internal diameter of collar 20 at specified distances above surface 10. Dimensions are specified in inches and all measurements were made with an accuracy of about ±0.03 inch.

Example 1

TABLE 2

Internal diameter of collar 20 of height 3.25 inches at specified distances above level of surface 10.

| Distance above surface 10 (inches) | Inner diameter (inches) |
|---|---|
| 3.25 | 1.37 |
| 3.00 | 1.38 |
| 2.75 | 1.48 |
| 2.50 | 1.65 |
| 2.25 | 1.93 |
| 2.00 | 2.19 |
| 1.75 | 2.36 |
| 1.50 | 2.45 |
| 1.25 | 2.50 |
| 1.00 | 2.56 |
| 0.75 | 2.62 |
| 0.50 | 2.63 |
| 0.25 | 2.64 |
| 0.00 | 2.65 |

Example 2

TABLE 3

Internal diameter of collar 20 of height 2.75 inches at specified distances above level of surface 10.

| Distance above surface 10 (inches) | Inner diameter (inches) |
|---|---|
| 2.75 | 1.48 |
| 2.50 | 1.65 |
| 2.25 | 1.93 |
| 2.00 | 2.19 |
| 1.75 | 2.36 |
| 1.50 | 2.45 |
| 1.25 | 2.50 |
| 1.00 | 2.56 |
| 0.75 | 2.62 |
| 0.50 | 2.63 |
| 0.25 | 2.64 |
| 0.00 | 2.65 |

Example 3

TABLE 4

Internal diameter of collar 20 of height 2.75 inches at specified distances above level of surface 10.

| Distance above surface 10 (inches) | Inner diameter (inches) |
|---|---|
| 2.75 | 1.37 |
| 2.50 | 1.38 |
| 2.25 | 1.50 |
| 2.00 | 1.68 |
| 1.75 | 1.94 |
| 1.50 | 2.19 |
| 1.25 | 2.37 |
| 1.00 | 2.44 |
| 0.75 | 2.62 |
| 0.50 | 2.63 |
| 0.25 | 2.64 |
| 0.00 | 2.65 |

Example 4

In addition to the prototypes described in Examples 1, 2 and 3 above, several other prototypes were made in a similar manner using the same template by fabricating collars of different heights and corresponding to different segments of the template.

Discussion of Examples 1-4

Each of the prototype food holding receptacles as described in Examples 1-4 above, when in its respective first specified food holding orientation with surface 10 facing upward, was found to be stably supportable on a wide variety of bottles, cans, stemware glasses, non-stemware glasses, cups and mugs of diverse shapes and sizes (taken one beverage container at a time) (mode 1). These prototype receptacles were surprisingly stable when mounted on numerous beverage containers of diverse shapes and sizes even when there was a considerable gap in places between the outer wall of the beverage container and the inner surface of the collar when the receptacle was mounted on the beverage container. This feature contributes to the universal character of the food holding receptacle of the present invention. These prototype food holding receptacles were also stably mountable, in the first specified food holding orientation, on a connector unit that was attached to the upper section of a beverage container (mode 3).

In testing mode 1 of using this invention, a given prototype was found to be stably mountable on: more than 60 bottles having upper portions of diverse shapes and sizes; more than 6 cans having upper portions of diverse shapes and sizes; more than 15 non-stemware glasses having upper portions of diverse shapes and sizes; more than 15 stemware glasses having upper portions of diverse shapes and sizes; and more than 6 cups and mugs combined having upper portions of diverse shapes and sizes.

The prototype receptacles allowed the efficacy of mode 2 to be demonstrated even though they did not have a barrier surrounding the hole or an outer rim. When each receptacle was rotated 180° from its first specified food holding orientation about a horizontal axis, to provide the second specified food holding orientation with surface 12 facing upward (mode 2) the plates were able to stably support a variety of bottles, cans, non-stemware glasses, cups and mugs (taken one beverage container at a time) while the user held the plate by gripping collar 20.

Prototypes of the food holding receptacle of the present invention made in accordance with Examples 1-4 above were tested in dining situations using bottles, cans, stemware glasses, non-stemware glasses, cups and mugs. The prototypes were evaluated in all three modes of operation. These tests showed that the food holding receptacle of the present invention greatly facilitates dining in stand-up and other situations where the diner must support both the food holding receptacle and a beverage container simultaneously. The user can readily take food items from the receptacle while it is mounted on any of a wide variety of beverage containers; the user can repeatedly and conveniently remove and replace the receptacle relative to the beverage container when he or she wishes to drink from the beverage container. Depending on the type of beverage involved it is also convenient to use an extra-long straw to drink from the beverage container without having to remove the food holding receptacle from the beverage container. Prototypes with the hole located off-center on the base also worked satisfactorily.

Example 5

Figure 14:
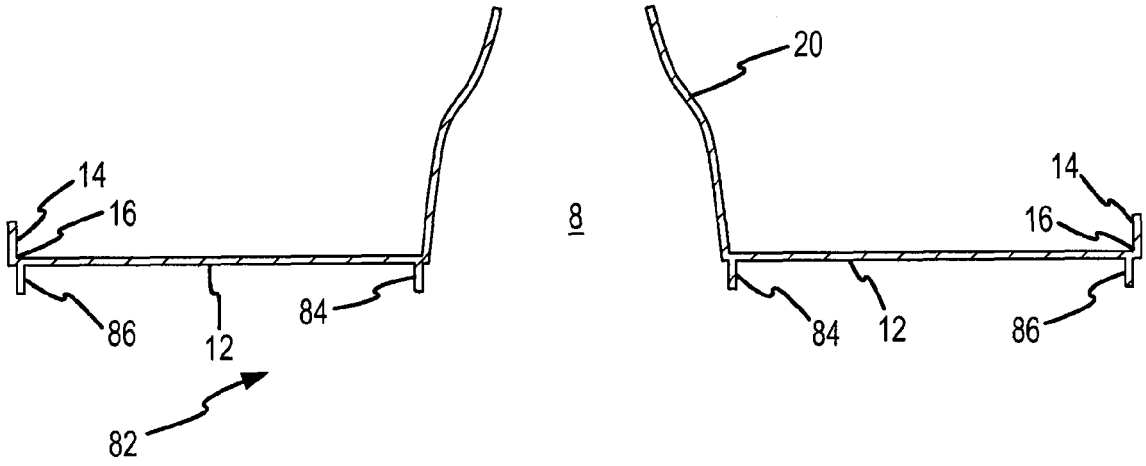
FIG. 14 shows a side view of an alternative embodiment of the food holding receptacle of the present invention.

FIG. 14 illustrates another prototype of the food-holding receptacle 82 of the present invention. This is similar to the embodiment shown in FIGS. 1 and 2 except that: (i) the embodiment in FIG. 14 has a cylindrical segment 84 symmetrically surrounding hole 8, and having a diameter slightly greater than that of hole 8, connected to and extending a short distance (e.g. 0.5 inch) from surface 12; and (ii) the embodiment in FIG. 14 has a cylindrical segment 86 near the outer edge 16 of receptacle 82 extending a short distance from surface 12. This prototype was made in a manner similar to the prototypes in Examples 1-4 except that the base was made from a cardboard cake circle with a hole cut in its center. An outer cardboard rim and a cardboard barrier surrounding the hole were glued to the surface opposite that from which the collar protrudes.

This prototype allowed the receptacle to be successfully used in both mode 1 and mode 2 in a stand-up dining situation. When used in mode 2 with surface 12 facing upward, segment 84 prevents food from falling into hole 8 and segment 86 prevents food from falling over the outer edge of the receptacle. Identical samples of food holding receptacle 82 are stackable for storage and shipping but are not as closely nestable as the embodiments shown in FIGS. 1 and 7. While segments 84 and 86 were cylindrical in the prototype this is not a necessary restriction and these segments may assume other forms such as frusto-conical. Furthermore segment 84 may be coincident with the perimeter of hole 8.

Example 6

Several prototypes of connector unit 66 similar to those shown in FIGS. 9A and 9B were evaluated. These prototype connector units were designed to snap onto the upper rim of frusto-conical cups and allowed the efficacy of mode 3 to be demonstrated. These prototype connector units worked very well and demonstrated that the connectors units functioned as intended in a dining situation.

Presently preferred embodiments of the invention have been described in this disclosure. These embodiments are intended to be illustrative of the invention and not limiting. The scope of the invention is defined by the appended claims. Other modifications of the invention will become obvious to those skilled in the art upon reading this disclosure and will be within the scope of the present invention.

I claim:

1. A universal food holding receptacle comprising:

a receptacle having a first specified food holding orientation, wherein said receptacle in said first specified food holding orientation is stably mountable in a loose-fitting relationship on multiple beverage containers, taken one beverage container at a time, each of said beverage containers in its respective specified beverage holding orientation, said multiple beverage containers being of diverse shapes, diverse sizes, or diverse shapes and sizes; and wherein said receptacle further comprises:

a base having a hole therethrough, said hole having a first perimeter;

a food holding section adjacent said hole when said receptacle is in said first specified food holding orientation; and a collar having an inner surface defined by a first end having a second perimeter that substantially coincides with said first perimeter of said hole such that said collar is joined to said base in a substantially fixed relationship and a second end having a third perimeter that is smaller than said first perimeter and said second perimeter.

2. The food holding receptacle as described in claim 1 wherein said multiple beverage containers comprise bottles, cans, stemware glasses, non-stemware glasses, cups and mugs.

3. The food holding receptacle as described in claim 1 wherein said receptacle is disposed to be freely supported on any one of said beverage containers.

4. The food holding receptacle as described in claim 1, wherein said collar is further configured to extend upwardly from said base when said receptacle is in said first specified food holding orientation, and said collar is suitably disposed to rest on an upper portion of the outer surface of said multiple beverage containers, taken one beverage container at a time, each beverage container in its specified beverage holding orientation and capable of partially penetrating said hole from underneath said receptacle in said first specified food holding orientation, said inner surface extending vertically above said hole when said receptacle is in said first specified food holding orientation and resting on each of said beverage containers.

5. The food holding receptacle as described in claim 4 wherein said receptacle is readily rotatable in a spinning manner relative to said beverage container about a vertical axis while said receptacle is stably mounted on said beverage container.

6. The receptacle of claim 1 wherein said collar has a restricting means that limits the extent to which said beverage container in said beverage holding orientation can enter said collar from beneath said receptacle when said receptacle is in said first specified food holding orientation.

7. The receptacle as described in claim 4 said collar having a chamber bound by said inner surface, wherein said inner surface is sized and contoured such that said chamber accommodates the upper portions of many beverage containers of diverse shapes and sizes, when said food holding receptacle is stably mounted on said beverage containers, taken one beverage container at a time.

8. The receptacle as described in claim 1 wherein said base has a rim at said outer edge, said rim joined to and extending upwardly from said base when said receptacle is in said first specified food holding orientation.

9. The universal food holding receptacle as described in claim 4 wherein said receptacle is selected from one of a plate, a bowl, a dish, or a tray.

10. The food holding receptacle as described in claim 1 wherein said base generally conforms to a shape selected from the group of geometries consisting of circular, oval, triangular, square, rectangular, polygonal, and dumbbell, each with a hole therethrough.

11. The food holding receptacle as described in claim 4 wherein said receptacle is one of a set of substantially similar receptacles and wherein said substantially similar receptacles are stackable such that the upward facing surface of one receptacle is complementary to the downward facing surface of an adjacent receptacle.

12. The food holding receptacle of claim 4, wherein said receptacle is one of a set of substantially similar receptacles and wherein said substantially similar receptacles are stackable such that said receptacles nest when said receptacles are placed one on top of another.

13. The food holding receptacle as described in claim 4 wherein said receptacle has a second specified food holding orientation, said second specified food holding orientation obtained by rotating said receptacle essentially 180° with respect to said first specified food holding orientation about a horizontal axis, and wherein a beverage container in its specified beverage holding orientation is stably supportable on said food holding receptacle in said second specified food holding orientation.

14. The receptacle as described in claim 13 wherein a frusto-conical cup is stably supportable on said food holding receptacle in said second specified food holding orientation.

15. The food holding receptacle as described in claim 13 wherein said receptacle has a rim at said outer edge, said rim comprising a first segment and a second segment; said first segment joined to and extending above said base when said receptacle is in said first specified food holding orientation, and said second segment joined to and extending above said base when said receptacle is in said second specified food holding orientation, said first segment and said second segment extending completely around said food holding section.

16. The food holding receptacle as described in claim 13 further comprising a circumferential barrier adjacent to and surrounding said hole; said barrier joined to and extending above said base when said receptacle is in said second specified food holding orientation and wherein all parts of said food holding receptacle bear a substantially fixed spatial relationship to each other and wherein said spatial relationship does not change substantially when said beverage container is mounted on said receptacle.

17. The food holding receptacle as described in claim 13 wherein when said beverage container is stably mounted on said receptacle in said second specified food holding orientation, a lower part of said beverage container is surrounded by said inner surface of said collar.

18. The food holding receptacle as described in claim 17 wherein said collar is disposed to function as an insulating means to insulate a user's hand that is gripping said collar from the heat or coldness of said beverage container.

19. The receptacle as described in claim 1, further comprising a separate collar insert to facilitate contact between said inner surface and part of the outer surface of a beverage container upon which said receptacle is mounted, said collar insert comprising: tubular segment that is open at both ends, an internal surface and an external surface; said external surface of said insert is generally complementary to said inner surface of said collar of said receptacle; and whereby said insert can be lodged within said collar to act as a cushioning means for portions of beverage containers that are inserted into said collar.

20. The receptacle as described in claim 4 in combination with a connector unit to facilitate mounting said receptacle on a beverage container; said connector unit comprising a tubular segment having a lower end and an upper end; said lower end of said connector unit disposed to engage an upper portion of said beverage container in a leak-proof manner; and said inner surface disposed to rest on said upper end of said connector unit, said inner surface extending vertically above said hole when said receptacle in said first specified food holding orientation is resting on said connector unit and said connector unit is engaged with said beverage container.

21. The receptacle as described in claim 1 wherein said receptacle in said first specified food holding orientation is devoid of any member or members downwardly extending from said base for stabilizing said receptacle on said beverage container.

22. The receptacle as described in claim 4 wherein said inner surface is specially contoured such that for each of said beverage containers of diverse shapes, diverse sizes or diverse shapes and sizes there is a favorably disposed suspension region on said inner surface for stably supporting said receptacle on each of said beverage containers.

23. In a food holding receptacle for mounting on a beverage container held in a user's hand, said receptacle having a first specified food holding orientation, said receptacle having a rim that is upwardly oriented when said receptacle is in said first specified food holding orientation, said rim extending around the outer edge of said receptacle, the improvement comprising the ability of said receptacle, in said first specified food holding orientation, to be stably mounted, in loose-fitting relationship, on multiple beverage containers of diverse shapes and sizes, taken one beverage container at a time, wherein each of said beverage containers is in its respective beverage holding orientation and whereby said receptacle can be repeatedly mounted on and demounted from the beverage container in a facile manner; and wherein said receptacle further comprises:

a base having a hole therethrough, said hole having a first perimeter;

a food holding section horizontally adjacent said hole when said receptacle is in said first specified food holding orientation; and a collar having an inner surface defined by a first end having a second perimeter that coincides with said first perimeter of said hole such that said collar is joined to said base in a substantially fixed relationship and a second end having a third perimeter that is smaller than said first perimeter and said second perimeter.

24. In the food holding receptacle as described in claim 23 the improvement further comprising that said receptacle is disposed to be freely mountable on each of said beverage containers.

25. In the food holding receptacle as described in claim 23 the improvement further comprising that all parts of said receptacle bear a substantially fixed spatial relationship to each other and that said relationship remains substantially unchanged as said receptacle is mounted on and demounted from said beverage containers.

26. In the food holding receptacle as described in claim 23 the improvement further comprising that said receptacle has a second specified food holding orientation, said second specified food holding orientation obtained by rotating said receptacle essentially 180° from said first specified food holding orientation about a horizontal axis.

27. In combination, a food holding receptacle and a beverage container, said receptacle having a first specified food holding orientation, said beverage container having a specified beverage holding orientation, said beverage container being one of multiple beverage containers of diverse shapes and sizes, wherein said receptacle is stably mountable, in a loose fitting relationship, on each of said multiple beverage containers, taken one beverage container at a time, said receptacle comprising:

a base;

a hole through said base, said hole having a first perimeter; and said hole being only partially penetratable by each of said multiple beverage containers;

said base having a food holding section when said receptacle is in said first specified food holding orientation; a collar joined to said base, said collar extending upwardly from said perimeter when said receptacle is in said first specified food holding orientation;

said collar provided with an inner surface defined by a first end having a second perimeter that coincides with said first perimeter of said hole such that said collar is joined to said base in a substantially fixed relationship and a second end having a third perimeter that is smaller than said first perimeter and said second perimeter, said inner surface having a universally accommodating form disposed to rest on, and partially surround, a portion of the outer surface of each of said multiple beverage containers of diverse shapes and sizes, taken one beverage container at a time, said inner surface extending vertically above said hole when said receptacle in said first specified food holding orientation is mounted on said beverage container in said beverage holding orientation; and whereby a single food holding receptacle of specific dimensions is stably mountable on said multiple beverage containers of diverse shapes and sizes, taken one beverage container at a time.

28. The combination as described in claim 27 wherein said collar has a restricting means preventing the complete passage of each of said beverage containers through said collar when said beverage containers in their specified beverage holding orientation are inserted into said collar from underneath said receptacle in its first specified food holding orientation, said restricting means located above level of said base when said food holding receptacle is in said first specified food holding orientation, and said restricting means having a cross-sectional area that is less than cross-sectional area of said hole.

29. The combination as described in claim 27 wherein bristles protrude from at least part of said inner surface.

30. An arrangement wherein both a beverage container and a food holding receptacle are simultaneously supported by a single hand of a diner wherein said beverage container, in its specified beverage holding orientation, is held in the diner's hand and said receptacle, in its specified food holding orientation, is stably mounted on said beverage container in loose fitting relationship, said beverage container being one of multiple beverage containers of diverse shapes, diverse sizes, or diverse shapes and sizes, said receptacle stably mountable on each of said multiple beverage containers taken one at a time; and wherein said receptacle further comprises:

a base having a hole therethrough, said hole having a first perimeter;

a food holding section horizontally adjacent said hole when said receptacle is in said first specified food holding orientation; and a collar having an inner surface defined by a first end having a second perimeter that coincides with said first perimeter of said hole such that said collar is joined to said base in a substantially fixed relationship and a second end having a third perimeter that is smaller than said first perimeter and said second perimeter.

31. The receptacle as described in claim 1 wherein when said receptacle is stably mounted on said beverage container the only force to be overcome in separating said receptacle from said beverage container is essentially the force of gravity alone acting on said receptacle.

32. The receptacle as described in claim 1 wherein said receptacle is stably mountable on said beverage container in the absence of each of a press-fit connection, a snap-on connection, a screw-on connection and a twist-on connection between said receptacle and said beverage container.

33. The receptacle, mountable on multiple beverage containers as described in claim 1, regardless of whether or not said beverage containers have a protruding lip, tab, or threading at their upper end.

34. The arrangement as described in claim 30 wherein said receptacle is stably mountable on said beverage container in the absence of each of a press-fit connection, a snap-on connection, a screw-on connection, and a twist-on connection between said receptacle and said beverage container.

35. The arrangement as described in claim 30 wherein said beverage container is devoid of each of a lip, a tab and threading that specifically engages or interlocks with a part of said receptacle.

36. The receptacle as described in claim 1 wherein said collar is configured to extend upwardly from said base when said receptacle is in said first specified food holding orientation, and wherein said inner surface of said collar is generally bottle-shaped comprising a neck section, a shoulder section and a body section in unitary combination; said neck section merging into said shoulder section of larger cross-sectional area, said shoulder section merging into said body section of still larger cross-sectional area, and wherein the end of said body section distal to said neck section comprises said first end of said collar.

37. The receptacle as described in claim 1 wherein said collar is configured to extend upwardly from said base when said receptacle is in said first specified food holding orientation, and wherein said inner surface of said collar is bottle-shaped, at least in part, comprising a shoulder section and a body section in unitary combination; said shoulder section merging into said body section of larger cross-sectional area, and wherein the end of said body section distal to said shoulder section comprises said first end of said collar.

38. The collar as described in claim 36 wherein all horizontal inner cross sections of the collar are substantially circular and the internal dimensions of the collar are selected from the group of dimensions consisting of Set A (3.25, 1.37), (3.00, 1.38), (2.75, 1.48), (2.50, 1.65), (2.25, 1.93), (2.00, 2.19), (1.75, 2.36), (1.50, 2.45), (1.25, 2.50), (1.00, 2.56), (0.75, 2.62), (0.50, 2.63), (0.25, 2.64), (0.00, 2.65); Set B (2.75, 1.48), (2.50, 1.65), (2.25, 1.93), (2.00, 2.19), (1.75, 2.36), (1.50, 2.45), (1.25, 2.50), (1.00, 2.56), (0.75, 2.62), (0.50, 2.63), (0.25, 2.64), (0.00, 2.65); and Set C (2.75, 1.37), (2.50, 1.38), (2.25, 1.50), (2.00, 1.68), (1.75, 1.94), (1.50, 2.19), (1.25, 2.37), (1.00, 2.44), (0.75, 2.62), (0.50, 2.63), (0.25, 2.64), (0.00, 2.65), where the first term in each bracketed pair refers to the vertical distance in inches from first end of said collar when said receptacle is in said first specified food holding orientation and the second term provides the corresponding internal diameters of the collar in inches.

39. The collar as described in claim 38 wherein each of said second terms has a tolerance of about plus/minus 0.02 inches.

40. The collar as described in claim 38 wherein each of said second terms has a tolerance of about plus/minus 0.05 inches.

41. The collar as described in claim 38 wherein each of said second terms has a tolerance of about plus/minus/minus 0.10 inches.

42. The collar as described in claim 38 wherein each of said second terms has a tolerance of about plus/minus 0.20 inches.

43. The collar as described in claim 38 wherein each of said second terms has a tolerance of about plus 0.30 inches.

44. The collar as described in claim 38 wherein each of said second terms has a tolerance of about plus/minus 0.50 inches.

45. The collar as described in claim 38 wherein each of said second terms has a tolerance of about plus/minus 0.75 inches.

46. The receptacle as described in claim 1 wherein all parts of said receptacle bear a substantially fixed spatial relationship to each other and wherein said relationship remains substantially the same regardless of whether said receptacle is mounted on said beverage containers or not mounted on said beverage containers.

47. The food holding receptacle as described in claim 1 wherein said collar is a permanent feature of substantially invariant shape.

48. The food holding receptacle as described in claim 1 wherein the loose-fitting relationship is characterized in that the receptacle will fall off the beverage container on which it is properly mounted upon inversion of said beverage container.

49. A universal food holding receptacle that facilitates supporting both said receptacle and an upright beverage container by a single hand of a diner in stand-up and similar dining situations, all parts of said receptacle being in fixed spacial relationship relative to each other before and during mounting of said receptacle on, and during and after demounting of said receptacle from, said beverage container, said receptacle comprising:

a dining plate having a first specified food holding orientation and a second specified food holding orientation, wherein said second specified food holding orientation is obtained by rotating said receptacle when in said first specified food holding orientation essentially 180° about a horizontal axis;

said receptacle in said first specified food holding orientation stably mountable on an upright beverage container that is held by a diner's hand, and, said receptacle, in said second specified food holding orientation, able to stably support an upright beverage container when said receptacle is held by a diner's hand; and wherein said receptacle further comprises:

a base having a hole therethrough, said hole having a first perimeter;

a food holding section horizontally adjacent said hole when said receptacle is in said first specified food holding orientation; and a collar having an inner surface defined by a first end having a second perimeter that coincides with said first perimeter of said hole such that said collar is joined to said base in a substantially fixed relationship and a second end having a third perimeter that is smaller than said first perimeter and said second perimeter.

50. The food holding receptacle as described in claim 49 wherein said receptacle in said first specified food holding orientation is stably mountable in loose-fitting relationship on said upright beverage container.

51. In combination a beverage container and a universal food holding receptacle, wherein said receptacle comprises:

a base having a hole therethrough, said hole having a first perimeter;

a food holding section horizontally adjacent said hole when said receptacle is in a first specified food holding orientation;

a collar having an inner surface defined by a first end having a second perimeter that substantially coincides with said first perimeter of said hole such that said collar is joined to said base in a substantially fixed relationship and a second end having a third perimeter that is smaller than said first perimeter and said second perimeter;

wherein when said receptacle is in a receptacle having said first specified food holding orientation it is mounted in loose-fitting relationship on said beverage container, which has a first end and a second end, said beverage container being at least one of a beverage can, a stemware glass, a non-stemware glass, a mug and a frusto-conical cup;

wherein said receptacle is substantially invariant in shape during its use in dining; and wherein said inner surface of said container is configured to engage said first end of said beverage container between said first end of said collar and said second end of said collar such that no part of said beverage container extends through said second end of said collar.

52. In the food holding receptacle of claim 23 wherein said receptacle is predisposed to be stably mountable in loose-fitting relationship, on multiple beverage containers, taken one beverage container at a time, and wherein said receptacle is substantially invariant in shape during its use in dining.

53. The receptacle as described in claim 37 wherein when said receptacle is stably mounted on a beverage container said shoulder section rests freely on a section of said beverage container.

54. The receptacle as described in claim 36 wherein the internal dimensions of said collar are based on the external dimensions of a master template having the following dimensions in inches:

| column A: | column B |
|---|---|
| 6.00 | 1.51 |
| 5.75 | 1.52 |
| 5.50 | 1.52 |
| 5.25 | 1.53 |
| 5.00 | 1.53 |
| 4.75 | 1.53 |
| 4.50 | 1.71 |
| 4.25 | 1.92 |
| 4.00 | 2.13 |
| 3.75 | 2.32 |
| 3.50 | 2.49 |
| 3.25 | 2.61 |
| 3.00 | 2.69 |
| 2.75 | 2.72 |
| 2.50 | 2.72 |
| 2.25 | 2.72 |
| 2.00 | 2.72 |
| 1.75 | 2.72 |
| 1.50 | 2.72 |
| 1.25 | 2.72 |
| 1.00 | 2.72 |
| 0.75 | 2.72 |
| 0.50 | 2.72 |
| 0.25 | 2.72 |
| 0.00 | 2.72 |

where column A contains values associated with the distance above the base of said template and column B gives the corresponding cross-sectional diameters, and wherein the internal dimensions of said collar are chosen to correspond to any half-inch or longer segment from column A that is suitable for being stably mounted on said beverage containers, and where the smallest value chosen from column A corresponds to said first end of said collar and the largest value chosen from column A corresponds to end of said collar distal to said first end.

55. The receptacle as described in claim 54 wherein the values in column B have a tolerance of plus/minus 0.05 inches, plus/minus 0.10 inches, plus/minus 0.20 inches, plus/minus 0.30 inches, plus/minus 0.40 inches, plus/minus 0.50 inches, plus/minus 0.60 inches or plus/minus 0.80 inches.

56. The receptacle as described in claim 37 wherein the internal dimensions of said collar are based on the external dimensions of a master template having the following dimensions in inches:

| column A: | column B |
|---|---|
| 6.00 | 1.51 |
| 5.75 | 1.52 |
| 5.50 | 1.52 |
| 5.25 | 1.53 |
| 5.00 | 1.53 |
| 4.75 | 1.53 |
| 4.50 | 1.71 |
| 4.25 | 1.92 |
| 4.00 | 2.13 |
| 3.75 | 2.32 |
| 3.50 | 2.49 |
| 3.25 | 2.61 |
| 3.00 | 2.69 |
| 2.75 | 2.72 |
| 2.50 | 2.72 |
| 2.25 | 2.72 |
| 2.00 | 2.72 |
| 1.75 | 2.72 |
| 1.50 | 2.72 |
| 1.25 | 2.72 |
| 1.00 | 2.72 |
| 0.75 | 2.72 |
| 0.50 | 2.72 |
| 0.25 | 2.72 |
| 0.00 | 2.72 |

where column A contains values associated with the distance above the base of said template and column B gives the corresponding cross-sectional diameters, and wherein the internal dimensions of said collar are chosen to correspond to any half-inch or longer segment from column A that is suitable for being stably mounted on said beverage containers, and where the smallest value chosen from column A corresponds to said first end of said collar and the largest value chosen from column A corresponds to end of said collar distal to said first end.

57. The receptacle as described in claim 56 wherein the values in column B have a tolerance of plus/minus 0.05 inches, plus/minus 0.10 inches, plus/minus 0.20 inches, plus/minus 0.30 inches, plus/minus 0.40 inches, plus/minus 0.50 inches, plus/minus 0.60 inches or plus/minus 0.80 inches.

58. The food holding receptacle as described in claim 1, further comprising a connector having an upper portion and a lower portion, said upper portion also having an aperture, said lower portion adapted to interconnect to a frusto-conical cup and said upper portion for engagement with said inner surface of said collar.

59. The food holding receptacle as described in claim 1, further comprising an insert for removable engagement within said collar, said insert adapted to receive the beverage container.

60. In the food holding receptacle as described in claim 23 wherein said multiple beverage containers include bottles, cans, non-stemware glasses, stemware glasses and cups.

61. The combination as described in claim 27 wherein said multiple beverage containers comprise bottles, cans, non-stemware glasses, stemware glasses and cups.

* * * * *

UNITED STATES PATENT AND TRADEMARK OFFICE

CERTIFICATE OF CORRECTION

PATENT NO. : 7,726,512 B2
APPLICATION NO. : 11/279363
DATED : June 1, 2010
INVENTOR(S) : Patrick MacCarthy It is certified that error appears in the above-identified patent and that said Letters Patent is hereby corrected as shown below:

In Claim 51, Column 37, line 16, cancel "a receptacle having".

Signed and Sealed this
Eighteenth Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,726,512 B2
APPLICATION NO. : 11/279363
DATED : June 1, 2010
INVENTOR(S) : Patrick MacCarthy It is certified that error appears in the above-identified patent and that said Letters Patent is hereby corrected as shown below:

In Claim 7, column 31, line 60, delete “the upper portions” and replace with --upper portions--.

In Claim 8, column 31, line 65, delete “said outer edge” and replace with --an outer edge--.

In Claim 15, column 32, line 34, delete “said outer edge” and replace with --an outer edge--.

In Claim 23, column 33, line 31, delete “the outer edge” and replace with --an outer edge--.

In Claim 30, column 35, line 2, delete “first specified” and replace with --specified--.

In Claim 41, column 36, line 9, delete “plus/minus/minus” and replace with --plus/minus--.

In Claim 43, column 36, line 14, delete “plus” and replace with --plus/minus--.

In Claim 51, column 37, line 24, delete “said container” and replace with --said receptacle--.

Signed and Sealed this
Sixteenth Day of October, 2012

David J. Kappos

David J. Kappos
*Director of the United States Patent and Trademark Office*